US010465374B2

(12) United States Patent
Sugaya et al.

(10) Patent No.: US 10,465,374 B2
(45) Date of Patent: Nov. 5, 2019

(54) FRAME STRUCTURE AND METHOD OF CONSTRUCTING FRAME STRUCTURE

(71) Applicant: SUMITOMO MITSUI CONSTRUCTION CO. LTD., Tokyo (JP)

(72) Inventors: Kazuhito Sugaya, Ageo (JP); Masahiro Nakajima, Narashino (JP); Hiroshi Shinjo, Saitama (JP); Kouichi Hasuo, Nagareyama (JP); Junji Sako, Mitaka (JP)

(73) Assignee: SUMITOMO MITSUI CONSTRUCTION CO., LTD., Tokyo (JP)

( * ) Notice: Subject to any disclaimer, the term of this patent is extended or adjusted under 35 U.S.C. 154(b) by 0 days.

(21) Appl. No.: 15/573,995

(22) PCT Filed: Dec. 4, 2015

(86) PCT No.: PCT/JP2015/006047
§ 371 (c)(1),
(2) Date: Nov. 14, 2017

(87) PCT Pub. No.: WO2017/013694
PCT Pub. Date: Jan. 26, 2017

(65) Prior Publication Data

US 2018/0291611 A1 Oct. 11, 2018

(30) Foreign Application Priority Data

Jul. 17, 2015 (JP) ..... 2015-142982

(51) Int. Cl.
*E04B 1/21* (2006.01)
*E04B 1/58* (2006.01)
*E04C 5/06* (2006.01)

(52) U.S. Cl.
CPC ..... *E04B 1/21* (2013.01); *E04B 1/5837* (2013.01); *E04C 5/06* (2013.01); *E04B 2103/02* (2013.01)

(58) Field of Classification Search
CPC ..... E04B 1/21; E04B 1/5837; E04B 2103/02; E04C 5/06
(Continued)

(56) References Cited

U.S. PATENT DOCUMENTS 938,458 A * 11/1909 Brockhausen ..... E04B 5/43 52/283
1,031,043 A * 7/1912 Conzelman ..... E04B 5/43 52/252
(Continued)

FOREIGN PATENT DOCUMENTS

CH 576049 A5 * 5/1976 ..... E04B 1/21
DE 2641403 A1 * 3/1978 ..... E04B 1/21
(Continued)

OTHER PUBLICATIONS

International Search Report for PCT/JP2015/006047 dated Feb. 10, 2016, 4 pages.

*Primary Examiner* — Patrick J Maestri
*Assistant Examiner* — Joseph J. Sadlon
(74) *Attorney, Agent, or Firm* — Dority & Manning, P.A.

(57) ABSTRACT

Provided is a frame structure which allow PC members to be assembled in an efficient manner. First blind holes 26 are formed in a first PC beam 11 so as to open out at longitudinal end surfaces thereof, and first through holes 31 are formed in a pair of PC columns 10 so as to open out opposite to the respective first blind holes 26. The first PC beam 11 is rigidly connected to each PC column 10 via a first rebar 32 positioned in each first through hole 31 and inserted in the corresponding first blind hole 26 to be connected to the corresponding first main beam rebar 24 via a first overlap
(Continued)

joint 33, and grout filled around the first rebar 32 in the first through hole 31.

10 Claims, 15 Drawing Sheets

(58) Field of Classification Search
USPC ..... 52/650.1
See application file for complete search history.

(56) References Cited

U.S. PATENT DOCUMENTS 1,031,048 A * 7/1912 Conzelman ..... E04B 1/185 52/283
2,150,982 A * 3/1939 McFarland ..... E01C 11/14 404/62
2,569,669 A * 10/1951 Henderson ..... E04B 1/21 52/283
3,212,222 A * 10/1965 Wittfoht ..... E04C 5/10 52/223.14
3,708,933 A * 1/1973 Yang ..... E04B 1/34315 52/236.4
3,712,008 A * 1/1973 Georgiev ..... E04B 1/34807 52/79.12
3,744,196 A * 7/1973 Weese ..... E04B 1/34823 52/70
3,762,115 A * 10/1973 McCaul, III ..... E04B 1/34823 52/236.6
3,971,179 A * 7/1976 Bodocsi ..... E04B 1/24 52/223.11
4,099,360 A * 7/1978 Outram ..... E02D 5/523 52/126.7
4,211,045 A * 7/1980 Koizumi ..... E04B 1/21 52/251
4,269,384 A * 5/1981 Saeed ..... E01D 19/00 248/548
4,302,915 A * 12/1981 Stocks ..... E04H 6/10 52/175
4,330,970 A * 5/1982 Bonink ..... E04B 1/215 52/125.4
4,437,272 A * 3/1984 Johnson ..... E04B 1/3538 52/125.1
4,603,522 A * 8/1986 Johnson ..... E04B 1/04 52/125.4
4,630,412 A * 12/1986 Engstrom ..... E04B 1/98 52/1
4,781,006 A * 11/1988 Haynes ..... E04B 1/215 52/583.1
4,959,940 A * 10/1990 Witschi ..... E04B 1/0038 52/223.13
5,123,220 A * 6/1992 Simenoff ..... E04B 1/22 52/236.8
5,366,672 A * 11/1994 Albrigo ..... B28B 23/043 264/219
5,410,847 A * 5/1995 Okawa ..... E04B 1/30 403/346
6,052,964 A * 4/2000 Ferm ..... E01C 7/147 404/64
6,065,263 A * 5/2000 Taguchi ..... E04B 5/023 403/305
6,308,478 B1 * 10/2001 Kintscher ..... E04B 1/0038 403/269
6,651,394 B2 * 11/2003 Hughes ..... E04B 1/215 277/646
6,681,545 B1 * 1/2004 James ..... E04G 23/0218 52/745.21
6,735,994 B2 * 5/2004 Buhler ..... B21F 5/00 72/20.1
7,171,787 B2 * 2/2007 Thomason ..... E04H 4/0087 52/169.7
7,444,786 B2 * 11/2008 Morgenstern ..... E04B 1/20 52/233
7,765,764 B2 * 8/2010 Zambelli ..... E04B 1/215 52/223.13
7,934,347 B2 * 5/2011 Brienen ..... E04C 5/0645 52/259
8,381,485 B2 * 2/2013 Platt ..... B28B 7/164 14/74.5
8,490,363 B2 * 7/2013 Nagy ..... E04B 1/04 52/745.05
8,539,726 B2 * 9/2013 Laiho ..... E01C 11/14 404/59
8,667,754 B2 * 3/2014 Schalla ..... B29C 70/222 52/362
8,863,445 B2 * 10/2014 Zhong ..... E04B 1/165 52/79.14
8,875,458 B2 * 11/2014 Fritschi ..... E04B 1/003 52/259
8,959,867 B2 * 2/2015 Schold ..... E04B 1/185 403/217
9,038,339 B2 * 5/2015 Zhong ..... E04B 1/161 52/204.1
9,388,562 B2 * 7/2016 Thomas ..... E04B 5/04
9,410,320 B2 * 8/2016 Murata ..... E04C 5/0604
9,506,266 B2 * 11/2016 Foldenauer ..... E04H 12/16
9,534,411 B2 * 1/2017 Kurosawa ..... E04C 5/012
9,644,369 B2 * 5/2017 Reigstad ..... E04B 5/023
9,683,361 B2 * 6/2017 Timberlake ..... E04C 5/0604
10,202,763 B2 * 2/2019 Hogan ..... E04B 2/90
10,378,199 B2 * 8/2019 Calderon Uriszar-Aldaca ..... E04B 1/1912
2002/0083652 A1 * 7/2002 Hughes ..... E04B 1/215 52/2.11
2009/0025307 A1 * 1/2009 Crichlow ..... E04B 1/3211 52/81.1
2009/0049778 A1 * 2/2009 Kralic ..... E04B 1/04 52/309.17
2009/0263185 A1 * 10/2009 Yee ..... E04C 5/165 403/314
2011/0297057 A1 * 12/2011 Kennedy ..... E21D 21/00 109/79
2012/0233936 A1 * 9/2012 Zhong ..... E04B 1/165 52/173.1
2014/0060721 A1 * 3/2014 Hongo ..... E04C 5/00 156/71
2014/0373471 A1 * 12/2014 Knepp ..... E04C 3/005 52/296
2015/0000227 A1 * 1/2015 Yee ..... F16B 7/0433 52/745.21
2015/0176278 A1 * 6/2015 Reigstad ..... E04B 5/32 52/223.6

FOREIGN PATENT DOCUMENTS

FR 645900 A * 11/1928 ..... E04B 1/21
FR 708726 A * 7/1931 ..... E04B 1/21
FR 2359941 A1 * 2/1978 ..... E04B 1/046
FR 2438126 A1 * 4/1980 ..... E04B 1/20
FR 2438719 A1 * 5/1980 ..... E04B 1/21
GB 696144 A * 8/1953 ..... E04B 1/21
JP 02252815 A * 10/1990 ..... E02D 5/76
JP H06173339 6/1994
JP 06185108 A * 7/1994 ..... E04B 1/21
JP H0893049 4/1996
JP 2909451 B1 * 6/1999
JP 2000220210 A * 8/2000
JP 2006009359 A * 1/2006 ..... E04B 1/20
JP 3837390 10/2006
JP 2006348664 12/2006
JP 2009293192 12/2009
JP 4496023 7/2010

* cited by examiner 21
21
10
27
31a
26
32a
32
27
26
32a
32

24
11A
37
37
33
32
36
31
35
10
21
21
38
31a
38
16
24
26
33
32
L1
34
13
14
15

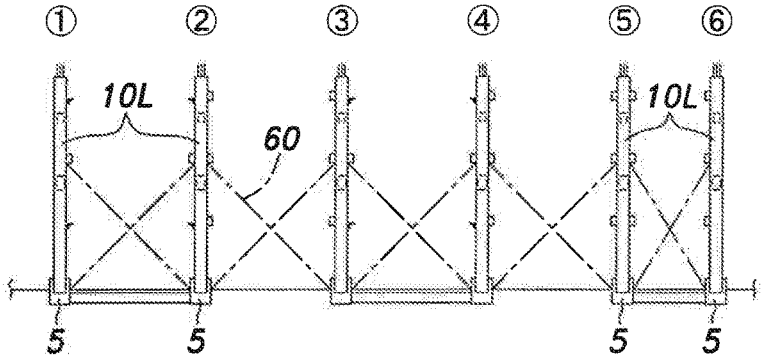
Fig.11A1
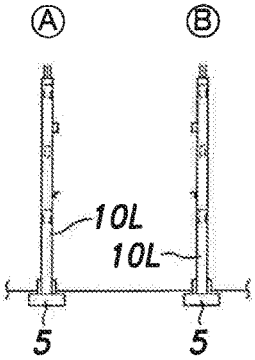
Fig.11A2
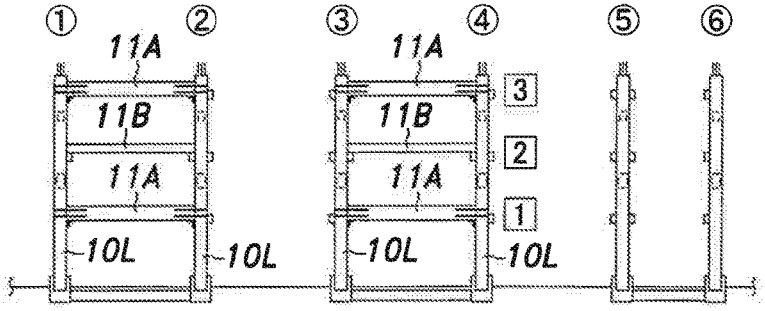
Fig.11B1
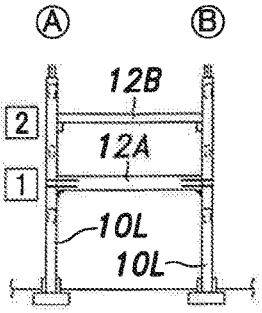
Fig.11B2
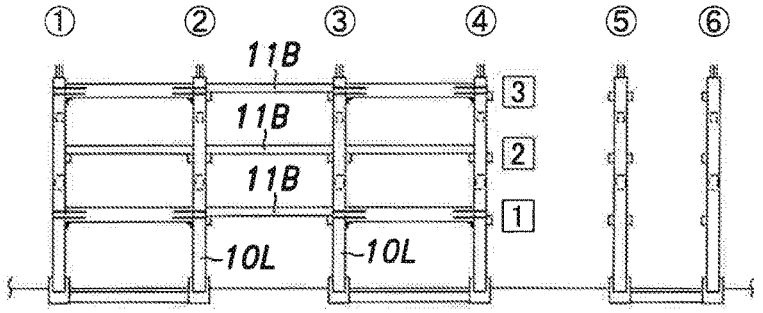
Fig.11C1
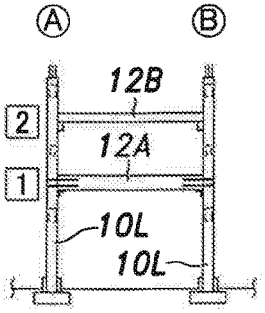
Fig.11C2

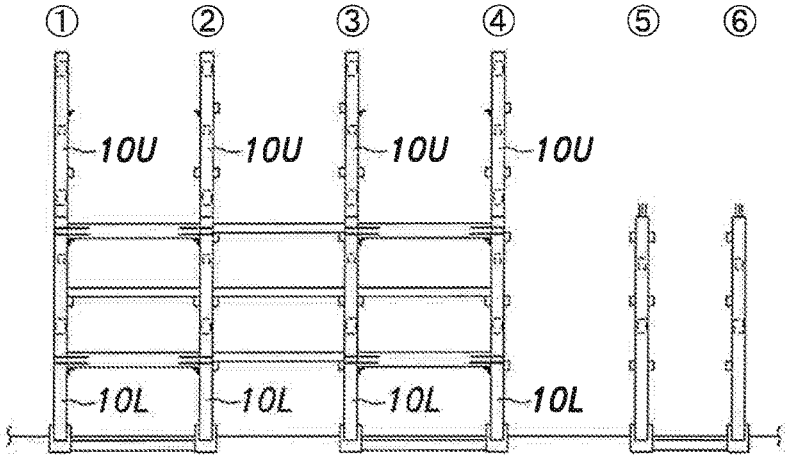
Fig.12D1
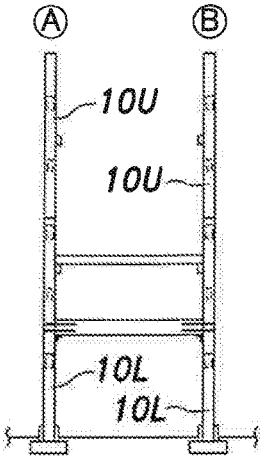
Fig.12D2
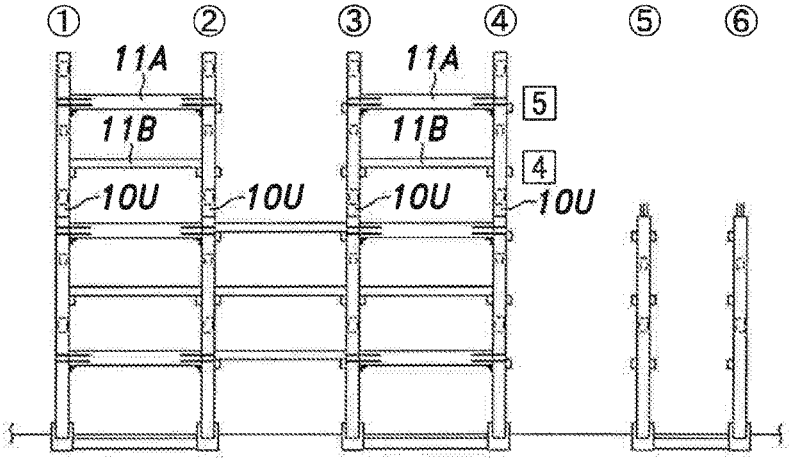
Fig.12E1
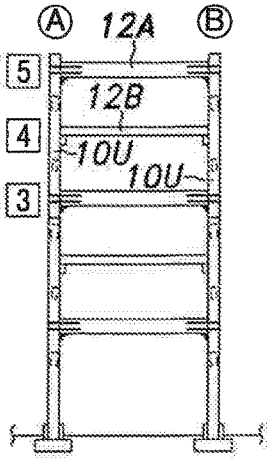
Fig.12E2
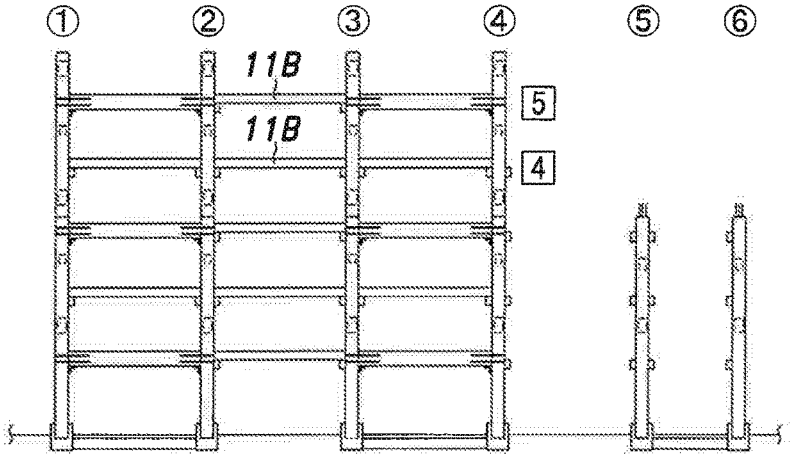
Fig.12F1
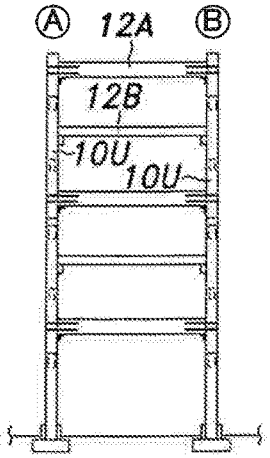
Fig.12F2

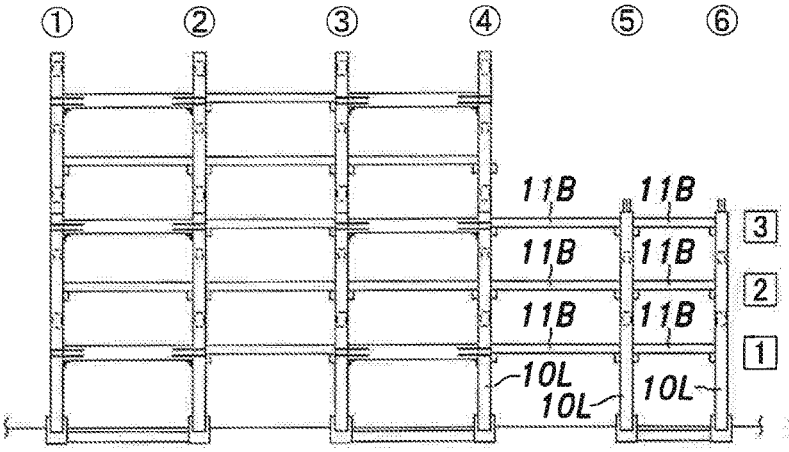
Fig.13G1
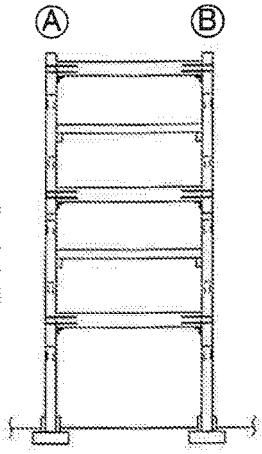
Fig.13G2
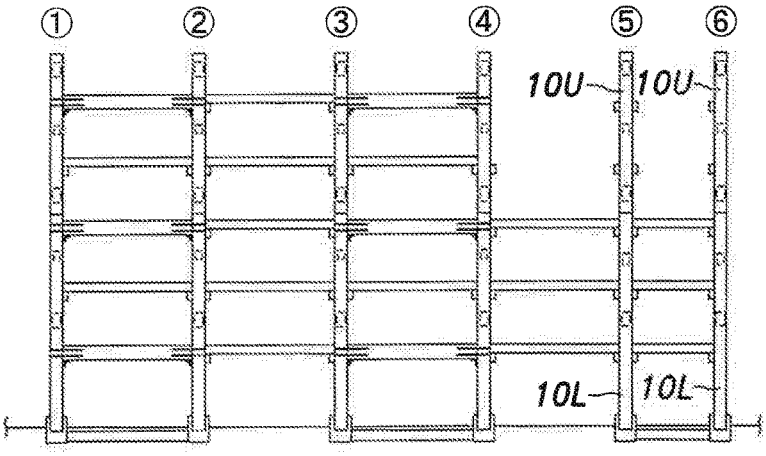
Fig.13H1
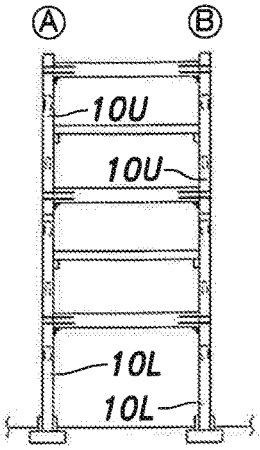
Fig.13H2
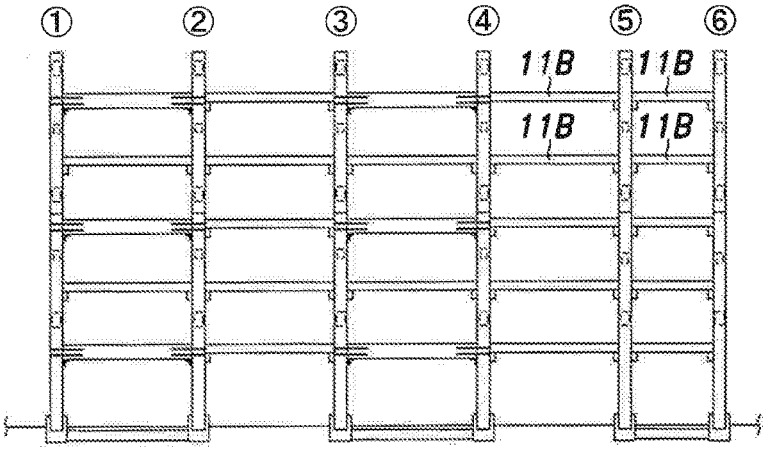
Fig.13I1
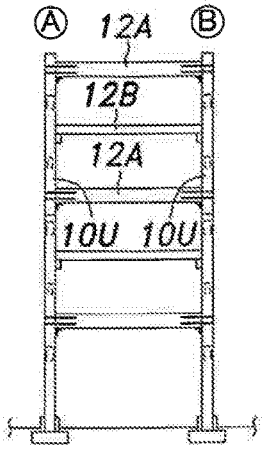
Fig.13I2

FRAME STRUCTURE AND METHOD OF CONSTRUCTING FRAME STRUCTURE

CROSS REFERENCE TO RELATED APPLICATIONS

This application is the U.S. National Stage entry of International Application Number PCT/JP2015/006047 filed under the Patent Cooperation Treaty having a filing date of Dec. 4, 2015, which claims priority to Japanese Patent Application Number 2015-142982 having a filing date of Jul. 17, 2015.

TECHNICAL FIELD

The present invention relates to a frame structure using precast (PC) columns and precast beams, and a method of constructing such a frame structure.

BACKGROUND OF THE INVENTION

A reinforced concrete (RC) frame structure typically consisting of a rigid frame structure requires a relatively long time period for construction and intensive quality management owing to the need for placing rebars, assembling/fabricating formwork and pouring concrete on site. For this reason, precast concrete (PC) members fabricated in a fabrication plant and assembled on site are being preferred in some applications.

Various methods for constructing rigid frame structure by using such PC members without requiring concrete to be poured into a connecting part (such as those for connecting a beam to a column) between adjoining PC members have been proposed. See Patent Documents 1 and 2, for instance. In such a method, typically, PC members formed with through holes for inserting main column rebars and main beam rebars, and PC members having mechanical joint members embedded in the connecting end surface thereof are prepared, and after the PC members are placed in the prescribed positions, the end part of each connecting rebar passed into the corresponding through hole of the particular PC member is connected to the corresponding mechanical joint of the adjoining PC member.

PRIOR TECHNICAL DOCUMENT(S)

Patent Document(s)

Patent Document 1: JP3837390B
Patent Document 2: JP4496023B

SUMMARY OF THE INVENTION

Task to be Accomplished by the Invention

In the conventional methods of constructing rigid frame structures, for the purpose of minimizing the number of mechanical joints, PC beams having main beam rebars projecting from longitudinal end surfaces to serve as connecting rebars are used. Therefore, when positioning the PC beams and PC connecting members, the PC beams and the PC columns are required to be moved horizontally so that a skilled crane operator and well trained workers are required for properly positioning the various PC members. Also, because the PC columns, the PC connecting members and the PC beam members are required to be positioned in an alternating manner, there is so much restriction in the ordering of work steps so that it is difficult to execute the construction work in an efficient manner.

The present invention was made in view of such problems of the prior art, and has a primary object to provide a frame structure and a method of constructing a frame structure which allow PC members to be assembled in an efficient manner.

Means for Accomplishing the Task

To achieve such an object, the present invention provides a frame structure (1) comprising a plurality of PC (precast) columns (10) arranged in a first direction (X) in plan view, and at least one first PC beam (11) incorporated with first main beam rebars (24) including an upper rebar and a lower rebar each extending in a longitudinal direction of the at least one first PC beam, each first PC beam being supported by a pair of the PC columns (10) adjoining each other in the first direction (X); wherein each first PC beam (11) is formed with first blind holes (26) opening out from each longitudinal end surface thereof so as to each form a first joint (33, 72) for a corresponding end of the corresponding first main beam rebar (24), and each of the adjoining PC columns (10) is formed with first through holes (31) opening out opposite to the first blind holes (26); and wherein each longitudinal end of the first PC beam (11) is rigidly connected to the corresponding PC column (10) by a first rebar (32) inserted in each first blind hole and the corresponding first through hole, the first rebar being connected to the corresponding first main beam rebar (24) via the first joint (33, 72), and a gap defined around the first rebar (32) in the first through hole (31) being filled with grout.

Owing to this arrangement, because the first PC beam can be positioned between the two PC columns before placing the first rebars, the positioning of the first PC beam and the PC columns is simplified, and the PC columns and the first PC beam can be positioned one after another in a highly efficient manner.

In this invention, it may be arranged such that each first blind hole (26) extends along and adjacent to the corresponding first main beam rebar (24), and the first main beam rebar (24) overlaps with the first rebar (32) over a prescribed joint length, the first joint consisting of an overlap joint (33) formed by mutually overlapping parts of the first rebar (32) and the first main beam rebar (24) in the first blind hole (26) and the grout filled in the gap around the first rebar (32) in the first blind hole (26).

Owing to this arrangement, each PC column can be rigidly connected to the associated first PC beam without requiring a mechanical joint so that the material cost can be saved.

In this invention, it may be arranged such that each first blind hole (26) is formed by a tubular member (71) retaining a longitudinal end part of the first main beam rebar (24), and each first joint consists of a mechanical joint (72) configured to retain the longitudinal end part of the first rebar (32) with the tubular member.

Owing to this arrangement, the first rebar can be connected to the first main beam rebar in a reliable manner.

In this invention, it may be arranged such that each first rebar (32) is provided with a radially projecting anchoring part (32*a*) positioned inside the corresponding first through hole (31).

Owing to this arrangement, the first rebar can be anchored or retained to the PC column in a reliable manner. Even when the cross sectional dimensions of the PC column may not be adequate to ensure a reliable anchoring of the first rebar, the first rebar can be anchored to the PC column in a reliable manner.

In this invention, it may be arranged such that each PC column (10) is provided with a support portion (13) for supporting the corresponding first PC beam (11).

Owing to this arrangement, without requiring any temporary structure such as support stanchions, the first PC beam can be connected to the PC column while the first PC beam is supported by the PC column in a stable manner so that the construction work for the PC columns and the first PC beam can be facilitated.

In this invention, it may be arranged such that the frame structure further includes PC columns (10) arranged in a second direction (Y) crossing the first direction (X) in plan view, and at least one second PC beam (12) including second main beam rebars (41) incorporated with an upper rebar and a lower rebar each extending in a longitudinal direction of the at least one second PC beam, each second PC beam (12) being supported by a pair of the PC columns (10) adjoining each other in the second direction (X); wherein each second PC beam (12) is formed with second blind holes (42) opening out from each longitudinal end surface thereof so as to each form a second joint (45) for a corresponding end of the corresponding second main beam rebar (41), and each of the adjoining PC columns (10) is formed with second through holes (43) opening out opposite to the respective second blind holes (42); and wherein each longitudinal end of the second PC beam (12) is rigidly connected to the corresponding PC column (10) by a second rebar (44) inserted in each second blind hole (42) and the corresponding second through hole (43), the second rebar (44) being connected to the corresponding second main beam rebar (41) via the second joint (45), and a gap defined around the second rebar (44) in the second through hole (43) being filled with grout.

Owing to this arrangement, the PC columns and the second PC beam can be arranged in the second direction in a simple manner similarly as in the first direction, and the PC columns and the second PC beam can be positioned one after another in a highly efficient manner.

In this invention, it may be arranged such that the first PC beams (11) are rigidly connected to the associated PC columns (10) at a different height from the second PC beams.

Owing to this arrangement, the first through holes are positioned away from the second through holes so that quality issues such as an inadequate penetration or filling of concrete which could occur during the process of manufacturing the PC columns due to crowding of the first through holes and the second through holes can be avoided. Also, the cross section dimensions of the columns are not required to be unduly increased to avoid quality control issues.

In this invention, it may be arranged such that at least three of the PC columns (10) are arranged in the first direction (X), and the first PC beams (11) are positioned between the corresponding adjoining pairs of the PC columns (10) in such a manner that a simply supported beam (11B) having two ends pivotally connected to the corresponding PC columns (10) and a fixedly supported beam (11A) having two ends fixedly connected to the corresponding PC columns (10) alternate one next to the other in the first direction (X).

In this arrangement, as not all of the beams extending in the first direction are required to be rigidly connected to the corresponding columns, the material cost can be saved, and the assembly work can be simplified due to the elimination of the work required for connecting the first rebars with the respective first main beam rebars.

In this invention, it may be arranged such that a plurality of first PC beams (11) are supported by a pair of the PC columns (10) adjoining in the first direction (X) at different elevations, the PC columns (10) being formed by sections whose lengths are adapted to the elevations of the first PC beams (11).

Owing to this arrangement, the number of the individual PC columns can be minimized, and not only the overall cost of the PC columns can be reduced but also the assembly work can be simplified.

In this invention, it may be arranged such that a plurality of first PC beams (11) are supported by a pair of the PC columns (10) adjoining in the first direction (X) at different elevations, in such a manner that a simply supported beam (11A) having two ends pivotally connected to the corresponding PC columns (10) and a fixedly supported beam (11B) having two ends fixedly connected to the corresponding PC columns (10) alternate one next to the other in a vertical direction.

In this arrangement, as not all of the beams arranged in the vertical direction are required to be rigidly connected to the corresponding columns, the material cost can be saved, and the assembly work can be simplified due to the elimination of the work required for connecting the first rebars with the respective first main beam rebars.

To accomplish the foregoing task, the present invention also provides a method of constructing a frame structure (1) including a plurality of PC columns (10) and at least one first PC beam (11) rigidly supported by an adjoining pair of the PC columns (10), the method comprising the steps of: preparing the first PC beam (11) incorporated with first main beam rebars (24) including an upper rebar and a lower rebar each extending in a longitudinal direction of the first PC beam (11), the first PC beam (11) being formed with first blind holes (26) opening out from each longitudinal end surface thereof so as to form first joints (33, 72) in end parts of the respective first main beam rebar (24), respectively; preparing the PC columns (10) each having first through holes (31) opening out at side surfaces thereof; placing a pair of the PC columns (10) along a first direction (X) in plan view; placing the first PC beam (11) between the two PC columns (10) so that the first blind holes (26) oppose the corresponding first through holes (31); inserting a first rebar (32) into each first through hole (31) and the corresponding first blind hole (26), and connecting the first rebar (32) with the corresponding first main beam rebar (24) via the corresponding first joint (33, 72); and filling each first through hole (31) with grout to fixedly secure the first rebar (32) to the corresponding PC column (10).

According to this arrangement, because the first PC beam can be positioned between the two PC columns before placing the first rebars, the positioning of the first PC beam and the PC columns is simplified, and the PC columns and the first PC beam can be positioned one after another in a highly efficient manner.

Effect of the Invention

Thus, the present invention provides a frame structure and a method of constructing a frame structure which allow PC members to be assembled in an efficient manner.

BRIEF DESCRIPTION OF THE DRAWINGS

FIG. 11 shows different steps of constructing the frame structure in side views (A1-C1) and in front views (A2-C2);

FIG. 12 shows different steps of constructing the frame structure in side views (D1-F1) and in front views (D2-F2);

FIG. 13 shows different steps of constructing the frame structure in side views (G1-I1) and in front views (G2-I2);

PREFERRED EMBODIMENT(S)

Preferred embodiments of the present invention are described in the following with reference to the appended drawings. To avoid crowding the drawings, rebars are sometimes omitted from illustration. In some of the side views and the front views, parts which are inside an enveloping structure, and are hence concealed from view may be shown for the purpose of illustration. Similarly, sectional views may show parts and/or members which are in fact not revealed on the cross section for the purpose of illustration.

First Embodiment

A first embodiment of the present invention is described in the following with reference to FIGS. 1 to 13. A frame structure 1 is schematically shown in side view in FIG. 1 and in front view in FIG. 2. The frame structure 1 of the illustrated embodiment consists of a segment of a pipe rack typically used in plant facilities, and a plurality of segments are arranged in a single row or as a matrix. In the following description of a single segment of the frame structure 1, the lateral direction in FIG. 1 is defined as a first direction X, and the lateral direction in FIG. 2 is defined as a second direction Y.

The frame structure 1 includes a plurality (at least four) of columns arranged in a plurality of rows in a first direction X and in a plurality of rows in a second direction Y. In the illustrated embodiment, the frame structure 1 includes twelve columns 2 in six rows in the first direction X and in two rows in the second direction Y. The angle formed between the first direction X and the second direction Y is 90 degrees in the illustrated embodiment. In other words, the columns 2 are arranged in a grid pattern extending in the first direction X and the second direction Y which are perpendicular to each other. However, the columns 2 may also be arranged in other different patterns without departing from the spirit of the present invention. In the following description, the rows of columns 2 arranged in the first direction X in FIG. 1 are numbered as row 1 to row 6 row from left to right, and the rows of columns 2 arranged in the second direction Y in FIG. 2 are numbered as row A and row B.

Figure 1:
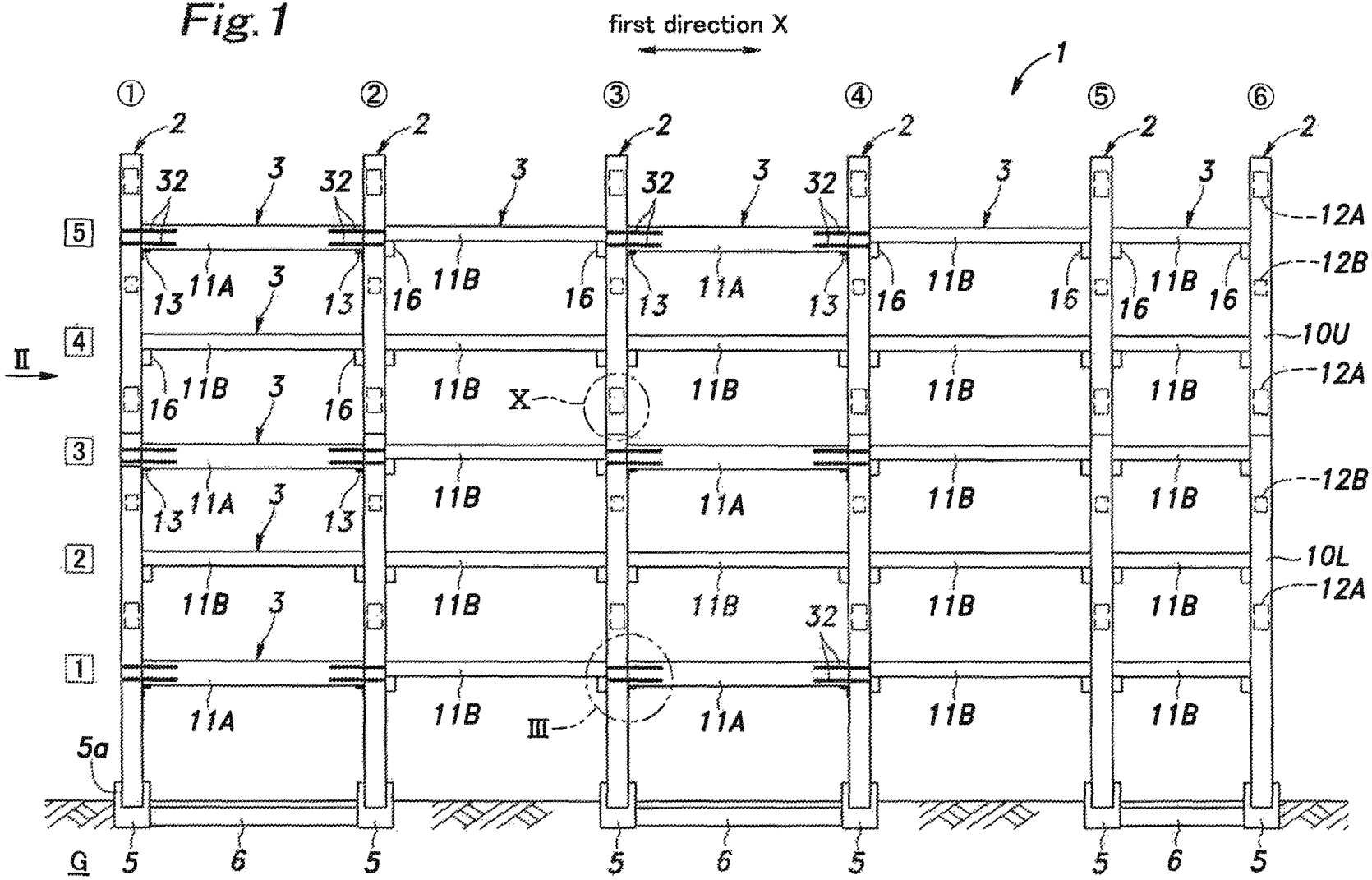
FIG. 1 is a side of a frame structure given as a first embodiment of the present invention.
Figure 2:
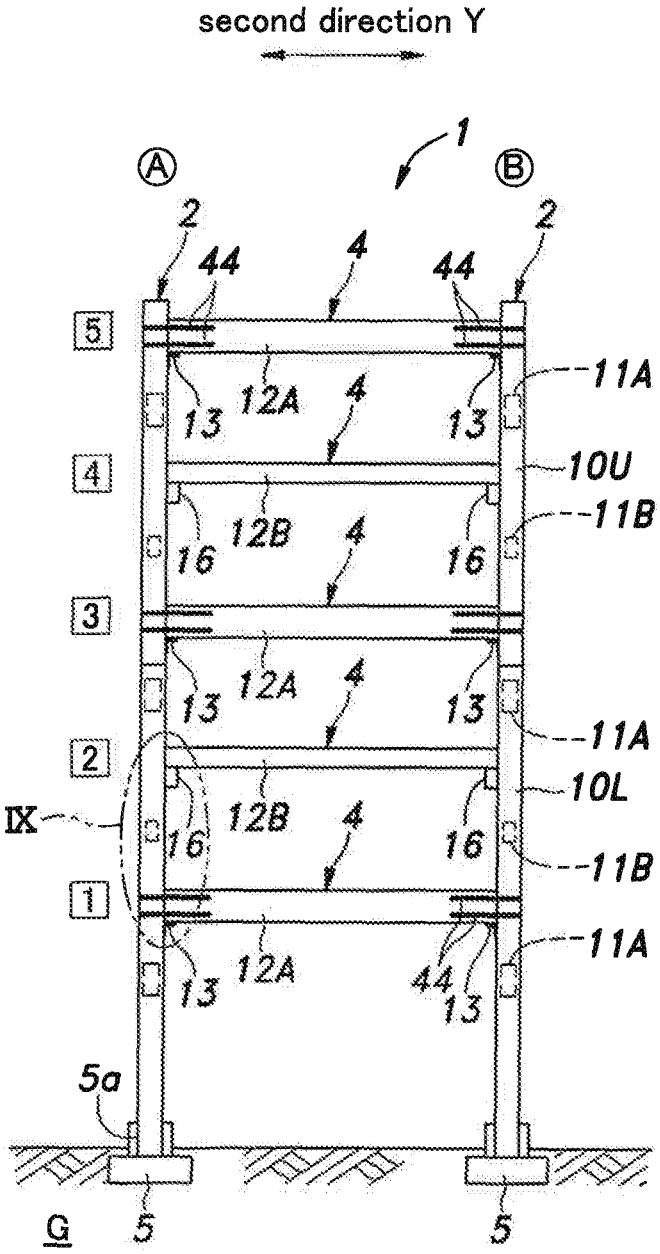
FIG. 2 is a front view of the frame structure as seen from the direction indicated by Roman numeral II in FIG. 1.

The frame structure 1 further includes first beams 3 supported by respective pairs of the columns 2 adjoining each other along the first direction X as shown in FIG. 1, and second beams 4 supported by respective pairs of the columns 2 adjoining each other along the second direction Y as shown in FIG. 2. The first beams 3 extend in the first direction X, and the second beams 4 extend in the second direction Y.

All the columns 2 have a same length. The distances between the adjoining columns of row 1 to row 5 are substantially the same, and the distance between row 5 and row 6 is shorter than the distance between the adjoining columns of row 1 to row 5. The distance between row A and row B is longer than the distance between the adjoining columns of row 1 to row 5.

All of the columns 2 are supported by respective footings 5 constructed so that the load can be transmitted to the ground G. The footings 5 for row 1 and row 2 are connected to each other via respective underground beams 6, and so are the footings 5 for row 3 and row 4 and the footing 5 for row 5 and row 6. On the other hand, the footing 5 for row 2 and row 3 are not connected to each other via underground beams, so are the footings for row 4 and row 5 and the footing 5 for row A and row B. Each footing 5 is provided with a peripheral wall 5*a* surrounding the lower end of the corresponding column 2 to enable the column 2 to stand by itself. Each column 2 includes a lower column part 10L consisting of a PC member erected on the corresponding footing 5, and an upper column part 10U consisting of a PC member erected on top of the lower column part 10L. In the following description, these column parts may be simply referred to as "column" when no distinction is required whether the particular column part is the upper or lower column part.

As shown in FIG. 1, the first beams 3 are supported by the columns 2 adjoining in the first direction X in five stages (five levels). The stages of the first beams 3 are referred to as the first stage to the fifth stage by counting from the lowermost stage. The five first beams 3 on each stage are positioned on a same plane between the adjoining columns 2 so that a linear continuous beam is formed jointly by the five individual first beams 3. Also, the vertical spacing of the first beams 3 of the adjoining stages is substantially the same. More specifically, the first beams 3 of the first to third stages are supported by the lower PC column parts 10L, and the first beams 3 of the fourth and fifth stages are supported by the upper PC column parts 10U.

Each first beam 3 supported by the corresponding pair of the adjoining columns 2 in the first direction X is formed by a first PC beam 11 (11A or 11B) made of a single PC member. In an alternate embodiment of the present invention, each first beam 3 is formed by a plurality of PC members that can be joined together in the longitudinal direction on site. In yet another embodiment of the present invention, all or part of the first beams 3 are formed as a composite of a PC member and concrete cured on site.

The first PC beams 11 of the first stage, the third stage and the fifth stage supported between the columns 2 or row 1 and row 2 and between the columns 2 of row 3 and row 4 each consist of a fixedly supported beam having each end rigidly connected to the corresponding PC column 10 by using first rebars 32 and grout as will be discussed hereinafter. The remaining first PC beams 11 each consist of a pivotally supported beam (simple beam) having each end pivotally connected (pin-connected) to the corresponding PC column 10. To distinguish these two kinds of beams, the first PC, beams 11 consisting of fixedly supported beams are referred to as first fixedly supported PC beams 11A, and the first PC beams 11 consisting of pivotally supported beams are referred to as first pivotally supported PC beams 11B. These beams are denoted with the corresponding numerals in the drawings as well.

In the frame structure 1 of the illustrated embodiment, the first fixedly supported PC beams 11A and the first pivotally supported PC beams 11B are arranged on each of the associated planes so as to alternate in the first direction X, and the first fixedly supported PC beams 11A and the first pivotally supported PC beams 11B are arranged for each of the associated column pairs so as to alternate in the vertical direction. In particular, on each of the first, third and fifth stages, the first fixedly supported PC beams 11A and the first pivotally supported PC beams 11B are arranged in an alternating manner in the first direction X between the PC columns 10 of row 1 to row 5. Also, between the columns 2 of row 1 and row 2 and between the columns of row 3 and row 4, the first fixedly supported PC beams 11A and the first pivotally supported PC beams 11B are arranged in an alternating manner in the vertical direction. In the illustrated embodiment, the first pivotally supported PC beams 11B have a smaller width and depth or a smaller cross section than the first fixedly supported PC beams 11A.

As shown in FIG. 2, second beams 4 are supported by each column pairs adjoining in the second direction Y at five different stages or levels. The vertically adjoining second beams 4 are spaced away from each other by a substantially same distance. The vertical distance between each adjoining pair of the second beams 4 is substantially the same as the vertical distance between each adjoining pair of the first beams 3. However, the second beams 4 of each stage is positioned higher than the first beams 3 of the same stage. In other words, the first beams 3 and the second beams 4 are supported by the adjoining column pairs at mutually different heights. The second beams 4 of the first and second stages are supported by the lower PC column parts 10L, and the second beams 4 of the third to fourth stages are supported by the upper PC column parts 10U. Each of the second beams 4 supported by the column pairs adjoining in the second direction Y consists of a second PC beam 12 (12A or 12B) made of a single PC member.

The second PC beams 12 of the first, third and fifth stages each consist of a beam having both ends thereof fixedly supported by the corresponding PC columns 10 by using second rebars 44 (which will be discussed hereinafter) and grout. The remaining PC beams 12 each consist of a beam having both ends thereof pivotally supported by the corresponding PC columns 10. To distinguish these two kinds of beams, the second PC beams 12 consisting of fixedly support beams are referred to as second fixedly supported PC beams 12A, and the second PC beams 12 consisting of pivotally supported beams are referred to as second pivotally supported PC beams 12B. These beams are denoted with the corresponding numerals in the drawings as well.

In the frame structure 1 of the illustrated embodiment, the second fixedly supported PC beams 12A and the second pivotally supported PC beams 12B extending in the second direction Y are arranged for each of the associated column pairs so as to alternate in the vertical direction. In the illustrated embodiment, the second pivotally supported PC beams 12B have a smaller width and depth or a smaller cross section than the second fixedly supported PC beams 12A. FIG. 2 shows a single row structure, but as shown in FIG. 1 in broken lines, the support structures or the connecting structures of the second PC beams 12 of the second to sixth rows are similar to those of the second PC beam 12 of the first row.

Figure 3:
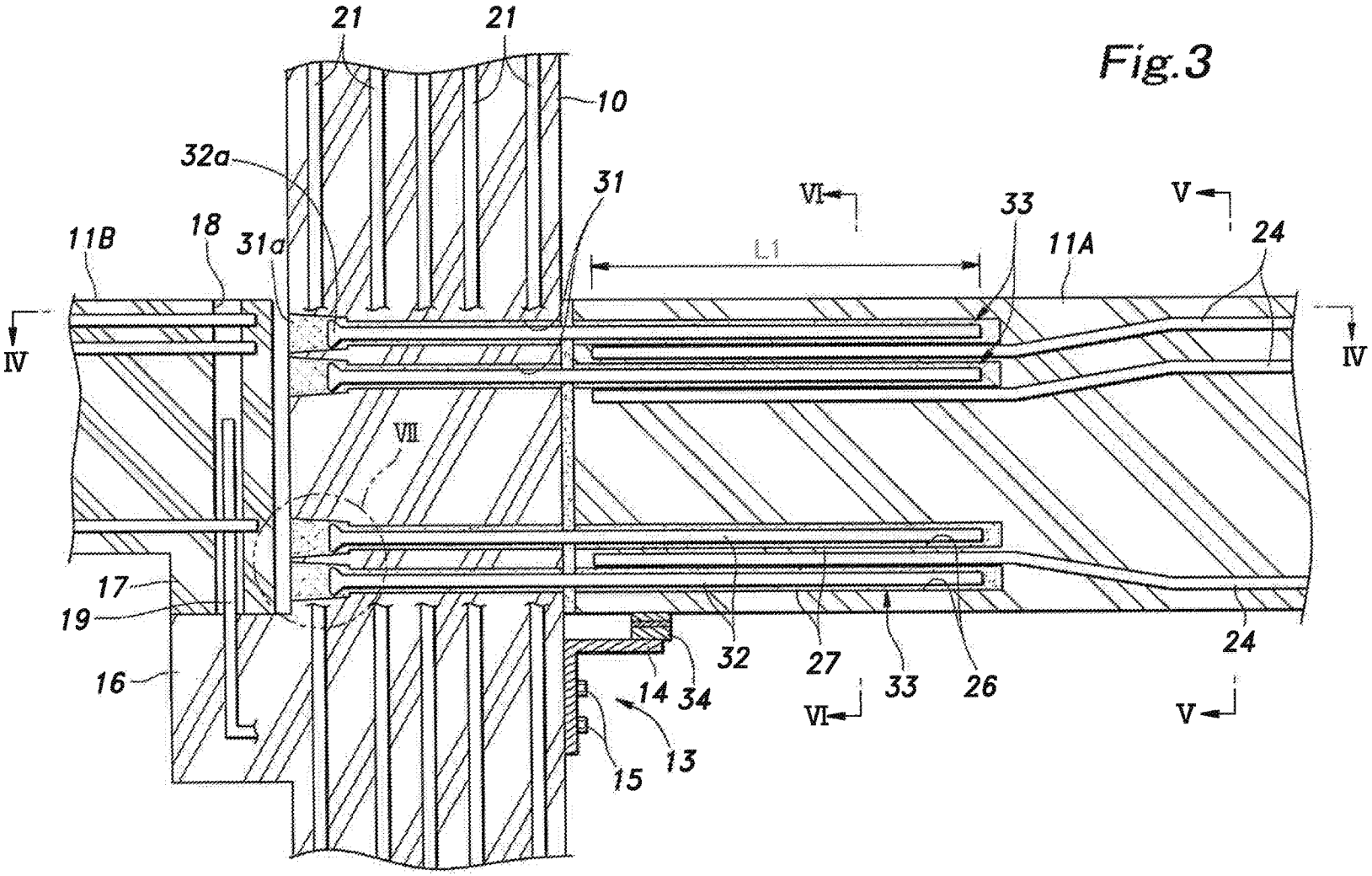
FIG. 3 is an enlarged sectional view of a part of FIG. 1 indicated by Roman numeral III.

FIG. 3 is an enlarged sectional view of a part of FIG. 1 indicated by Roman numeral III, and shows the connecting structure between one of the PC columns 10 and the corresponding first fixedly supported PC beam 11A and the connecting structure between the PC column 10 and the corresponding first pivotally supported PC beam 11B. FIG. 3 shows only one end of the first fixedly supported PC beam 11A and one end of the first pivotally supported PC beam 11B, and the other ends of these beams are symmetric to the respective one ends.

As shown in FIGS. 1 and 3, each PC column 10 is provided with first support portions 13 for supporting the corresponding first fixedly supported PC beams 11A. In the illustrated embodiment, each first support portion 13 includes an angle member 14 including a web extending horizontally under the connecting part between the corresponding first fixedly supported PC beam 11A and the corresponding PC column 10 and detachably attached to the PC column 10, nuts (not shown in the drawings) embedded in the PC column 10 and bolts threaded into the respective nuts, or stud bolts embedded in the PC column 10 and nuts threaded onto the respective stud bolts. The first support portions 13 are used for positioning the first fixedly supported PC beams 11A at the prescribed positions, and supporting the weight of the temporarily positioned first fixedly supported PC beams 11A until the first fixedly supported PC beams 11A are rigidly connected to the corresponding PC columns 10. Therefore, the angle members 14 may be removed after the first fixedly supported PC beams 11A have been rigidly connected to the corresponding PC columns 10.

Each first PC column 10 is provided with a second support portion 16 for supporting the corresponding first pivotally supported PC beam 11B. In the illustrated embodiment, the second support portion 16 consists of a reinforced concrete bracket integrally formed with the PC column 10 so as to project from the side surface of the PC column 10 in under the connecting part with the first pivotally supported PC beam 11B. The second support portions 16 are used both for temporarily positioning the first pivotally supported PC beams 11B at the respective prescribed positions, and for finally pivotally supporting the corresponding first pivotally supported PC beams 11B.

As mentioned earlier, in the illustrated embodiment, the first pivotally supported PC beams 11B have a smaller width and depth or a smaller cross section than the first fixedly supported PC beams 11A. The first pivotally supported PC beams 11B are positioned so that the first pivotally supported PC beams 11B are axially aligned with the first fixedly supported PC beams 11A, and the upper surfaces of the first pivotally supported PC beams 11B and the first fixedly supported PC beams 11A are flush with one another. Therefore, the second support portions 16 may be positioned below the lower surfaces of the corresponding first pivotally supported PC beams 11B so as not to interfere with first through holes 31 which will be described hereinafter, and each axial end of each first pivotally supported PC beam 11B is provided with a stilt part 17 consisting of a projection projecting downward from the lower surface thereof.

The connecting structure between each first pivotally supported PC beam 11B and the corresponding column 10 is not required to have any pivotal joint in a literal sense, but may be secured to the column 10 so as not to detach from the column 10 when the first pivotally supported PC beam 11B is put into use (for supporting and storing pipes). In the illustrated embodiment, a vertically extending positioning hole 18 is passed through each axial end of each first pivotally supported PC beam 11B where the corresponding stilt part 17 is formed. Correspondingly, a retaining rebar 19 projects from the upper surface of the second support portion 16 of the PC column 10. Thus, the first pivotally supported PC beam 11B is pivotally connected to the PC column 10 by placing the first pivotally supported PC beam 11B on the second support portion 16 in such a manner that the retaining rebar 19 is received in the positioning hole 18. The dimension of the positioning hole 18 along the longitudinal line of the first pivotally supported PC beam 11B is substantially greater than the diameter of the retaining rebar 19 so that the end part of the first pivotally supported PC beam 11B is moveable in the longitudinal direction of the first pivotally supported PC beam 11B.

Figure 4:
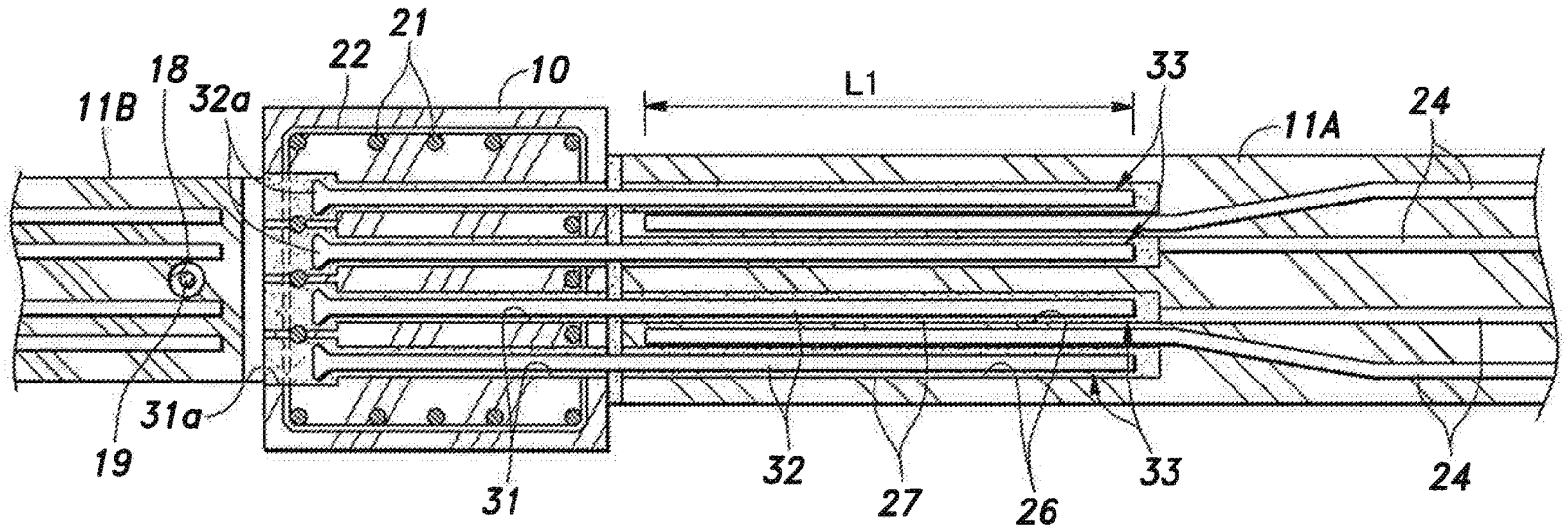
FIG. 4 is a sectional view taken along line IV-IV of FIG. 3.
Figure 5:
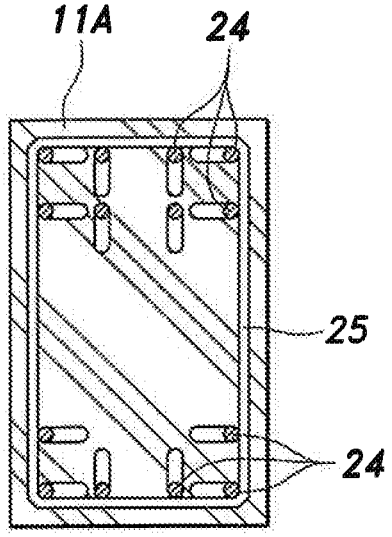
FIG. 5 is a sectional view taken along line V-V of FIG. 3.
Figure 6:
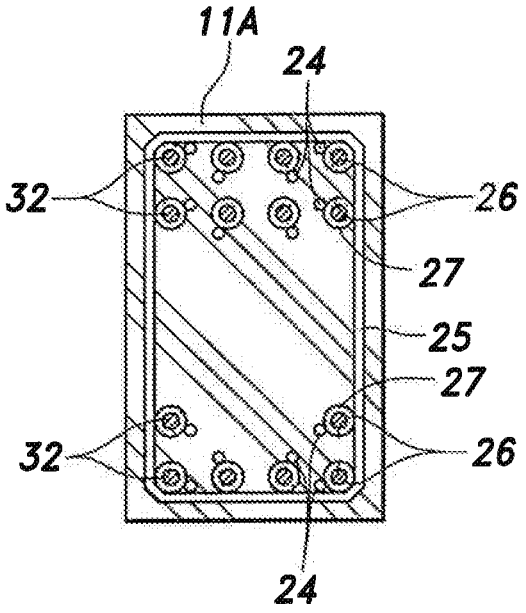
FIG. 6 is a sectional view taken along line VI-VI of FIG. 3.

FIG. 4 is a sectional view taken along line IV-IV of FIG. 3, and FIGS. 5 and 6 are sectional views of one of the first fixedly supported PC beams 11A taken along line V-V and line VI-VI of FIG. 3, respectively. As shown in FIG. 4, each PC column 10 has a substantially square cross section, and includes a plurality of main column rebars 21 extending in the axial direction and positioned along the outer peripheral part of the cross section, and a plurality of rectangular stirrups 22 positioned around the main column rebars 21. The main column rebars 21 are arranged at a substantially regular interval along the peripheral part of the cross section of the PC column 10.

As shown in FIG. 5, each first fixedly supported PC beam 11A has a vertically elongated rectangular cross section, and includes a plurality of first main beam rebars 24 extending in the axial direction and positioned along the outer peripheral part of the cross section, and a plurality of rectangular stirrups 25 positioned around the first main beam rebars 24. The first main beam rebars 24 include upper rebars that are arranged in two levels adjacent to the upper surface of the first fixedly supported PC beam 11A, and lower rebars that are arranged in two levels adjacent to the lower surface of the first fixedly supported PC beam 11A.

As shown in FIGS. 3, 4 and 5, the first main beam rebars 24 extend at a substantially regular interval adjacent to the upper and lower periphery of the first fixedly supported PC beam 11A in the longitudinally intermediate part thereof, but are bent inward both in the vertical and lateral directions in oblique directions. The first main beam rebars 24 are bent so as to extend in parallel to one another toward the longitudinal end of the first fixedly supported PC beam 11A, and terminate short of the longitudinal end of the first fixedly supported PC beam 11A so that the longitudinal ends of the first main beam rebars 24 are covered by a certain thickness of concrete.

As shown in FIGS. 3, 4 and 6, a plurality of blind holes 26 are formed in the longitudinal end of each first fixedly supported PC beam 11A so as to extend along the extension lines of the respective first main beam rebars 24 in the longitudinally intermediate part, and open out at the longitudinal end surface of the first fixedly supported PC beam 11A. The blind holes 26 may be formed at the time of fabricating (or casing) the respective first fixedly supported PC beams 11A by placing sheathes 27 in the casting mold along the first main beam rebars 24. In other words, the blind holes 26 extend along and adjacent to the respective first main beam rebars 24. Each sheath 27 may have an irregular wall surface or may consist of a spiral tube or the like so that the adhering force of the grout which is poured into the first blind hole 26 after inserting the corresponding first rebar 32 into the blind hole 26 may be maximized.

As shown in FIGS. 3 and 4, each PC column 10 is formed with a plurality of first through holes 31 that open out in alignment with the respective first blind holes 26. Each first through hole 31 extends along the longitudinal line of the first fixedly supported PC beam 11A in linear continuation of the opposing blind hole 26. Each first through hole 31 includes a radially enlarged part in the end part thereof remote from the first blind hole 26. The enlarged parts 31*a* of the first through holes 31 are separated from one another so that no air or bubble may be trapped in the grout filling the first blind holes 26.

Figure 7:
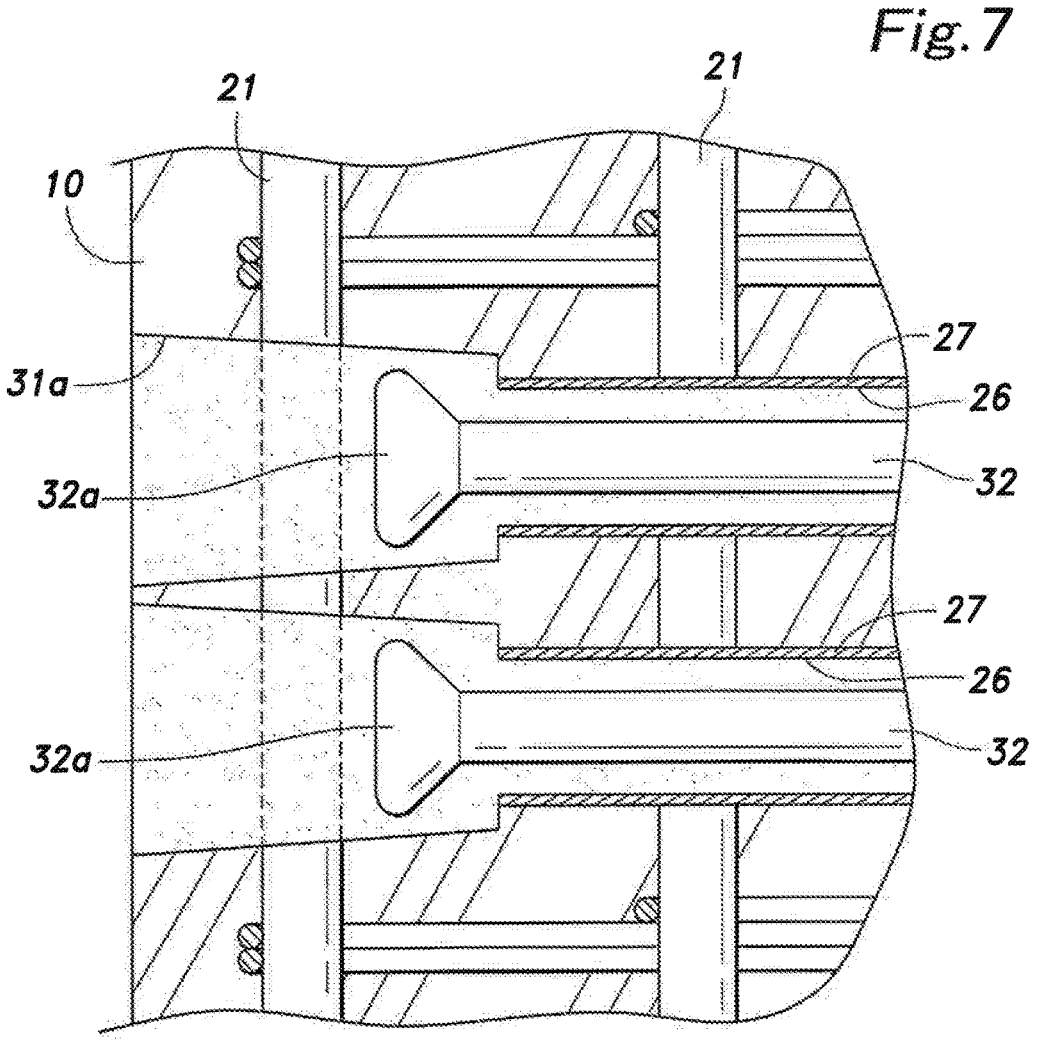
FIG. 7 is an enlarged view of a part of FIG. 3 indicated by Roman numeral VII.

FIG. 7 is an enlarged view of a part of FIG. 3 indicated by Roman numeral VII. As shown in FIGS. 3, 4 and 7, one of the first rebars 32 is inserted into each first through hole 31 and the corresponding first blind hole 26 from the side of the first through hole 31. The first rebar 32 is provided with ribbed surface, and a radially expanded conical head 32*a* is formed in the rear end thereof in terms of the direction of insertion. The length of the first rebar 32 is determined in such a manner that when the head 32*a* is positioned in the enlarged parts 31*a* of the corresponding first through hole 31, the part of the first rebar 32 inserted in the first blind hole 26 overlaps with the first main beam rebar 24 by a joint length of L1. After the first rebar 32 is inserted into the first through hole 31 and the first blind hole 26, these holes are filled with grout.

According to this arrangement, each first rebar 32 is joined to the corresponding first main beam rebar 24 via a first overlap joint 33 formed by the overlapping of the first rebar 32 and the first main beam rebar 24, and is firmly anchored to the PC column 10 owing to the retaining action of the head 32*a*. The head 32*a* may be omitted from the first rebar 32, since the cross sectional dimensions of the PC column 10 are so great, and the length of the first rebar 32 in the first through hole 31 is so great that the part of the first rebar 32 positioned in the first through hole 31 creates an adequate retaining force. Each head 32*a* is not required to be conical in shape as long as the first rebar 32 is retained in the PC column 10 with an adequate retaining force, but may also be disk-shaped or hook-shaped (by bending the end part of the first rebar 32), for instance.

Figure 8:
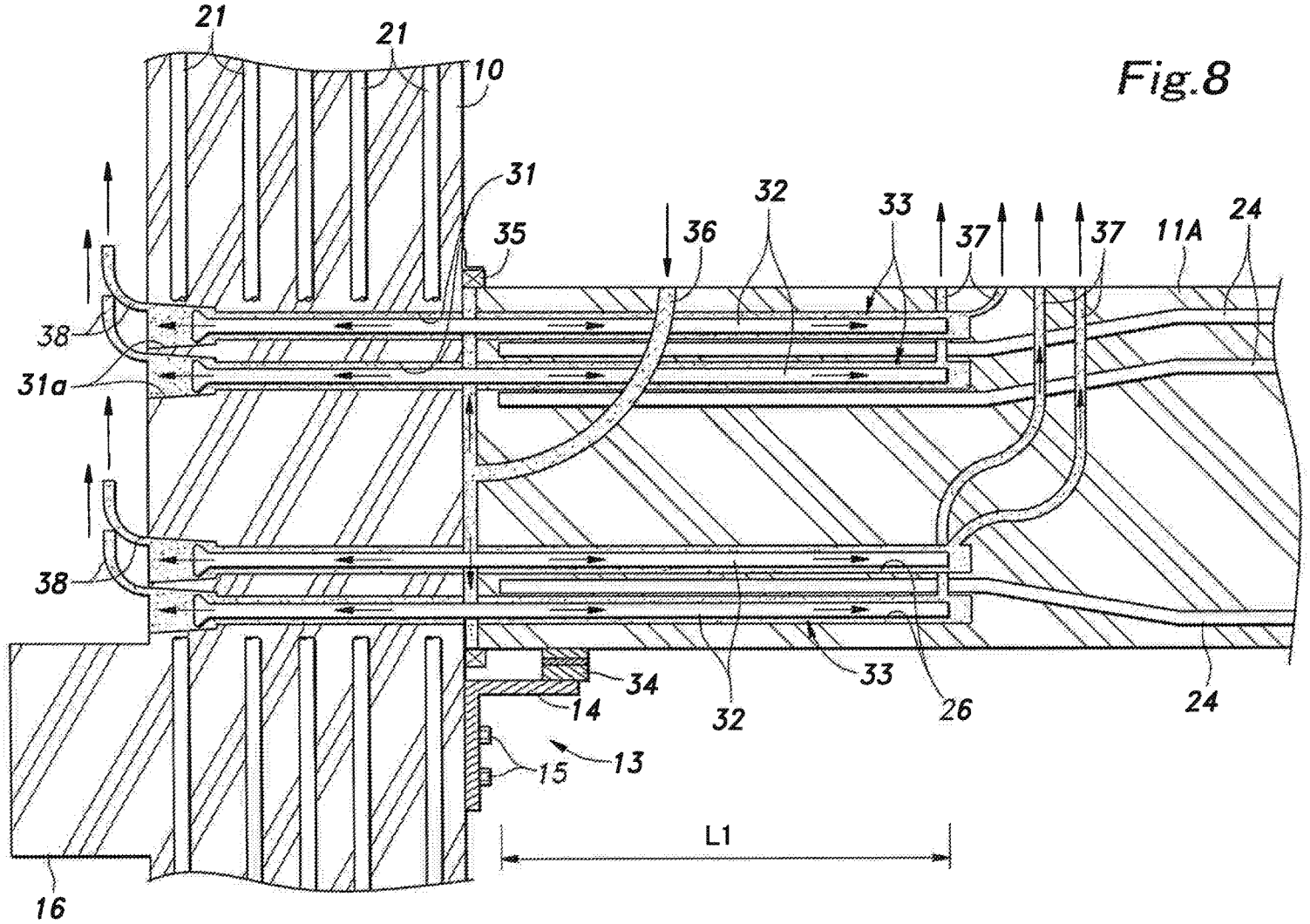
FIG. 8 is an enlarged sectional view of the part of FIG. 1 indicated by Roman numeral III during construction.

FIG. 8 is an enlarged sectional view of a part indicated by Roman numeral III in FIG. 1, similar to FIG. 3, showing an intermediate step of the method for connecting the first fixedly supported PC beam 11A to the PC column 10. As shown in the drawing, the first fixedly supported PC beam 11A is positioned between the pair of the PC columns 10 adjoining along the first direction X, and is slightly spaced apart from the PC columns 10 and the angle members 14. The first fixedly supported PC beam 11A is supported by level adjustment plates 34 placed on the respective angle members 14 until the first fixedly supported PC beam 11A is rigidly connected to the PC columns 10. Under this condition, each first blind hole 26 opposes the corresponding first through hole 31. Once the first fixedly supported PC beam 11A is properly positioned, the first rebars 32 are passed into the respective first through holes 31 and first blind holes 26 from the side of the first through holes 31, and are overlapped with the respective first main beam rebar 24 by the prescribed joint length L1. At this time, the first pivotally supported PC beam 11B and the stilt part 17 which are to be pivotally connected to the PC column 10 from the left side in FIG. 8 are not yet positioned.

The gap between the first fixedly supported PC beam 11A and each associated PC column 10 is provided for facilitating the positioning of the first fixedly supported PC beam 11A between the two adjoining PC columns 10. The gap between the first fixedly supported PC beam 11A and each associated angle member 14 is provided for allowing a mold 35 for filling grout in the gap between the PC column 10 and the first fixedly supported PC beam 11A to be positioned along the lower face of the first fixedly supported PC beam 11A. The mold 35 is provided in an annular configuration surrounding the longitudinal end of the first fixedly supported PC beam 11A so as to fill the gap between the first fixedly supported PC beam 11A and the PC column 10.

The first fixedly supported PC beam 11A is formed with a grout filling passage 36 having an upstream end opening out at the upper surface thereof and a downstream end opening out at the longitudinal end surface thereof. The first fixedly supported PC beam 11A is also formed with a plurality of air purge passages 37 having upstream ends at bottom parts of the respective first blind holes 26 and downstream ends opening out at the upper surface of the first fixedly supported PC beam 11A. The grout filling passage 36 and the air purge passages 37 may be formed of tubes embedded in the first fixedly supported PC beam 11A. Similarly, the PC column 10 is formed with a plurality of air purge passages 38 having upstream ends opening out at upper parts of the enlarged parts 31*a* of the respective first through holes 31 and downstream ends opening out at parts higher than the corresponding enlarged parts 31*a*. The tubes forming the air purge passages 38 may be attached to a part of the mold (not shown in the drawings) which is positioned so as to close the enlarged parts 31*a* of the first through holes 31.

When grout under pressure is introduced into the grout filling passage 36, the grout flows into the first blind holes 26 and the first through holes 31 via the gap between the first fixedly supported PC beam 11A and the PC column 10, and entirely fills the first blind holes 26 and the first through holes 31 while air in the grout is purged via the air purge passages 37 and 38 connected to these holes. Once the grout has entirely filled the first blind holes 26 and the first through holes 31, and starts flowing out of the air purge passages 37 and 38, the filling of the grout is completed. Once the grout has cured, the first fixedly supported PC beam 11A and the PC column 10 are rigidly connected to each other via the first rebars 32 joined to the respective first main beam rebar 24 via the corresponding first overlap joints 33 and the grout filling the gap around the first rebars 32 in the first blind holes 26 and the first through holes 31.

Figure 9:
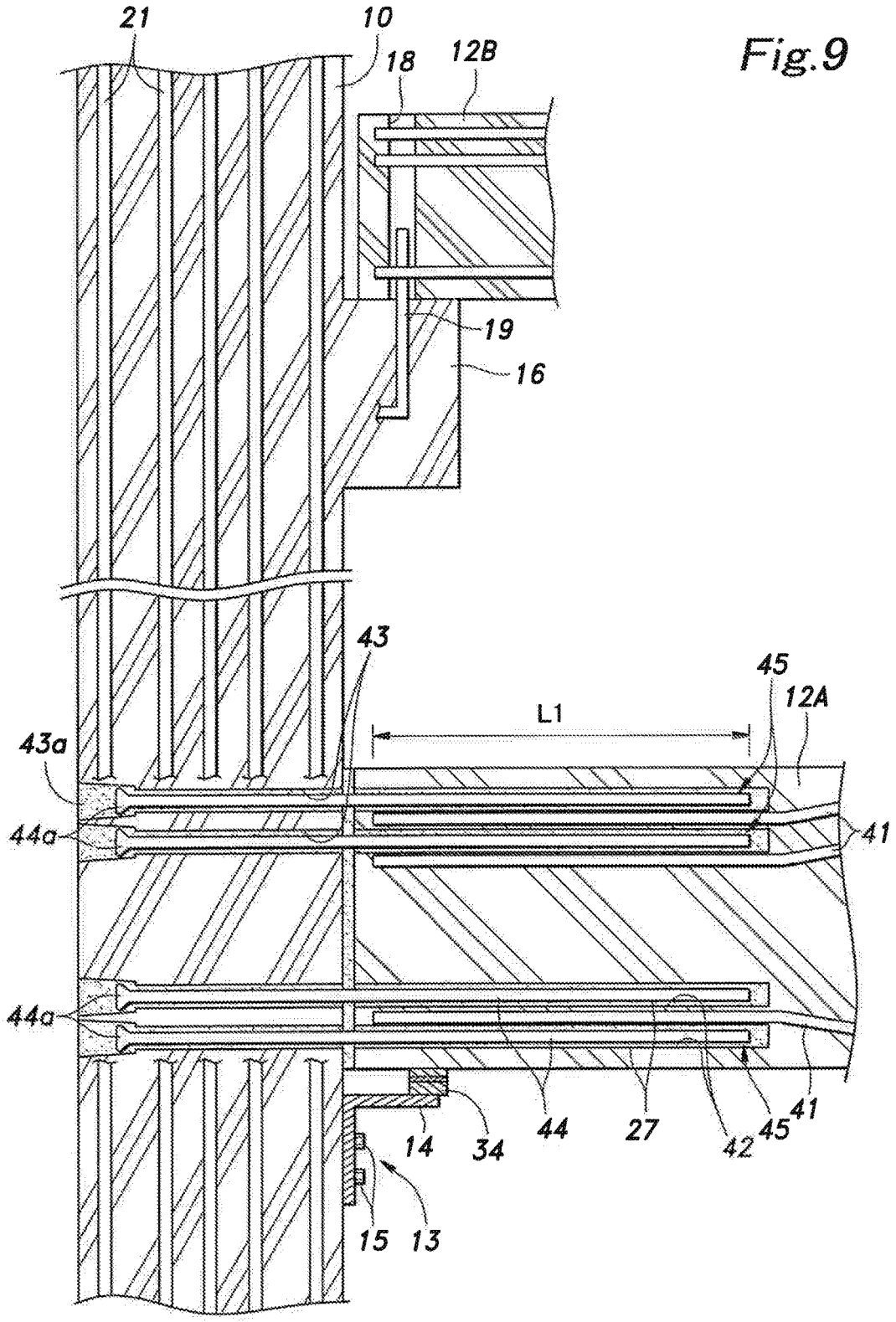
FIG. 9 is an enlarged view of a part of FIG. 2 indicated by Roman numeral IX.

FIG. 9 is an enlarged sectional view of a part indicated by Roman numeral IX in FIG. 2. The connecting structure between the second fixedly supported PC beam 12A and the PC column 10, and the connecting structure between the second pivotally supported PC beam 12B and the PC column 10 shown in FIG. 2 are similar to those between the first PC beams 11 and the PC columns 10 shown in FIGS. 1 and 3. As shown in FIGS. 2 and 9, a first support portion 13 is formed in a part of the PC column 10 somewhat below the part where the second fixedly supported PC beam 12A is connected to the PC column 10 for supporting the second fixedly supported PC beam 12A, and a second support portion 16 is formed in a part of the PC column 10 somewhat below the part where the second pivotally supported PC beam 12B is connected to the PC column 10 for supporting the second pivotally supported PC beam 12B.

Each second fixedly supported PC beam 12A is provided with a plurality of second main beam rebars 41, and second blind holes 42 that are formed along and adjacent to the respective second main beam rebars 41 and open out at the longitudinal end surface of the second fixedly supported PC beam 12A. Each associated PC column 10 is formed with second through holes 43 opening out opposite to the respective second blind holes 42. A second rebar 44 similar to the first rebar 32 is passed into each second through hole 43 and the corresponding second blind hole 42 so as to overlap with the corresponding second main beam rebar 41 by the prescribed joint length L1. After the second rebar 44 has been inserted into the second through hole 43 and the second blind hole 42, grout is introduced into the second through hole 43 and the second blind hole 42. Thereby, the second rebar 44 is connected to the second main beam rebar 41 via a second overlap joint 45, and at the same time, is retained to the PC column 10 with the head 44*a* serving as a retaining portion. Thus, the second fixedly supported PC beam 12A is rigidly connected to the PC column 10 owing to the second rebar 44 and the grout filling the second through hole 43 and the second blind hole 42 around the second rebar 44.

The structure for connecting each second pivotally supported PC beam 12B to the associated PC column 10 is similar to that for the first pivotally supported PC beams 11B. Here, each second pivotally supported PC beam 12B does not adjoin any of the first pivotally supported PC beams 11B along the second direction Y. Therefore, the second support portions 16 are not interfered by the second through holes 43 so that the second support portions 16 are not required to be positioned below the lower surface of the second pivotally supported PC beams 12B. Therefore, in the illustrated embodiment, each second pivotally supported PC beam 12B is not provided with a stilt part 17, and hence has a planar lower surface. The connecting structure is otherwise similar to that for the second pivotally supported PC beams 11B, and the detailed description of the similar parts is omitted from this disclosure.

Figure 10:
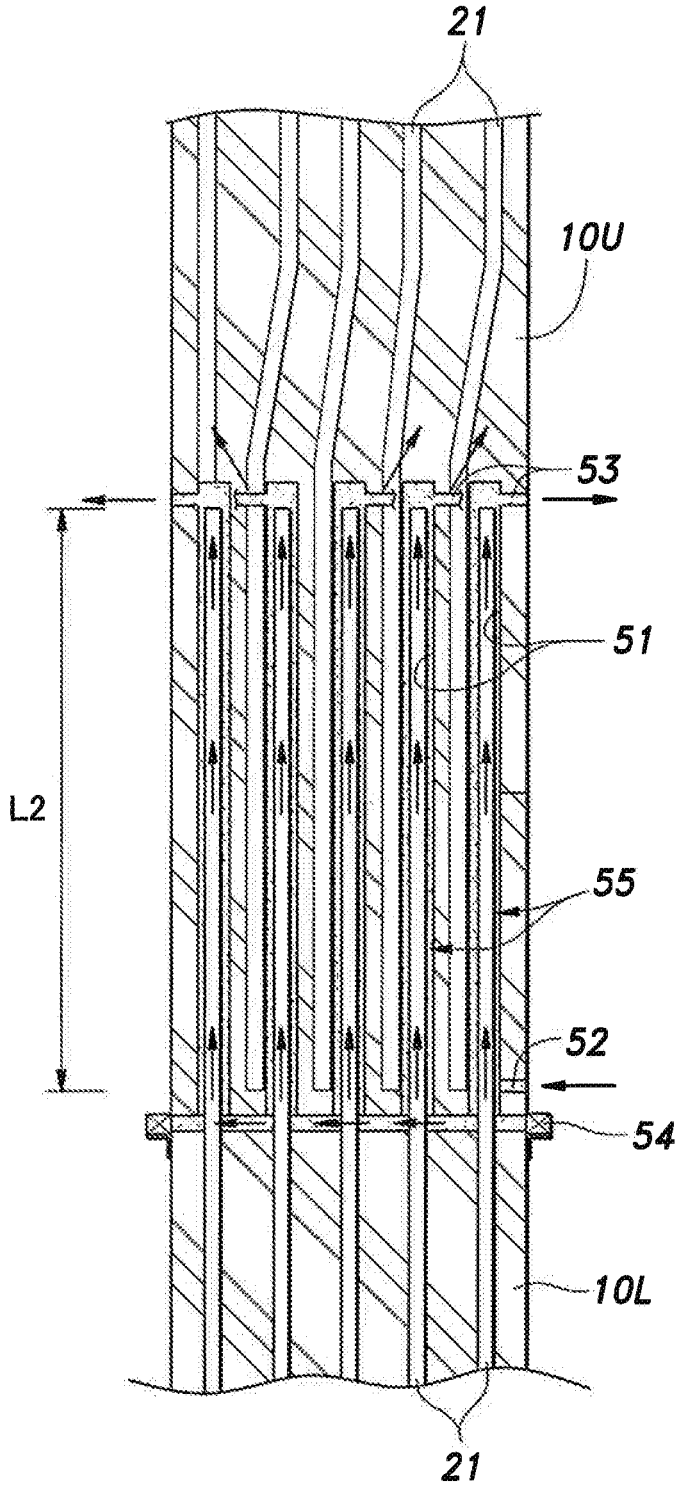
FIG. 10 is an enlarged sectional view of a part of FIG. 1 indicated by Roman numeral X during construction.

FIG. 10 is an enlarged sectional view of a part indicated by Roman numeral X in FIG. 1, and shows an intermediate step of fixedly securing one of the upper PC columns 10U to the associated lower PC column part 10L. As shown in this drawing, the lower PC column part 10L includes main column rebars 21 which extend linearly, and project upward from the upper end surface of the lower PC column part 10L. Meanwhile, the upper PC column part 10U is provided with vertical blind holes 51 opening at the lower end thereof so as to correspond to the main column rebars 21. The main column rebars 21 of the upper PC column part 10U are bent at a part above the vertical blind holes 51 so as to avoid the vertical blind holes 51, extend obliquely downward, and are then bent once again to extend vertically along and adjacent to the vertical blind holes 51, in a manner similar to the first main beam rebars 24 (FIGS. 3 and 4) of the first fixedly supported PC beams 11A.

Each upper PC column part 10U is hoisted down on top of the corresponding lower PC column part 10L such that the main column rebars 21 of the lower PC column part 10L are received in the respective vertical blind holes 51, and overlap with the respective main column rebars 21 of the upper PC column part 10U by a prescribed joint length L2. A spacer not shown in the drawing is placed on the top surface of the lower PC column part 10L so that a gap is created between the upper PC column part 10U and the lower PC column part 10L.

A grout introduction passage 52 is formed between a lower end part of one of the vertical blind holes 51 and an associated side part of the upper PC column part 10U, and a plurality of air purge passages 53 open out at the upper parts (bottom parts) of the vertical blind holes 51. Once the upper PC column part 10U is positioned on top of the lower PC column part 10L, a mold 54 is formed around the gap between the upper PC column part 10U and the lower PC column part 10L for containing the grout in the gap.

The grout introduced from the grout introduction passage 52 fills the interior of the vertical blind holes 51 via the gap between the upper PC column part 10U and the lower PC column part 10L. Once the grout has cured, the overlapping parts between the main column rebars 21 of the upper PC column part 10U and the main column rebars 21 of the lower PC column part 10L serve as third overlap joints 55 that connect the main column rebars 21 of the upper PC column part 10U to the respective main column rebars 21 of the lower PC column part 10L.

The sequence of constructing the frame structure 1 described above is discussed in the following with reference to FIGS. 11 to 13. The sequence discussed in the following is only exemplary, and does not limit the present invention. The alphabet letters (A to I) in FIGS. 11 to 13 indicate the chronological order of constructing the frame structure 11, and a suffix attached to each alphabet letter indicates the corresponding drawing number, A1 to I1 indicating side views of the frame structure 1 in FIG. 1, A2 to I2 indicating front views of the frame structure 1 in FIG. 2. When any one of the side views and the corresponding front view are referred to, the combination of the drawings is indicated merely by appending the corresponding alphabet to the drawing number, in such a manner as FIG. 11(A), for instance.

As shown in FIG. 11(A), at each of the points in row 1 to row 6 and row A and row B, the corresponding lower PC column part 10L is erected on the footing 5. After erecting each lower PC column part 10L, a suitable bracing 60 may be installed for preventing the lower PC columns 10L from falling over.

As shown in FIG. 11(B), the first to third stages of the first PC beams 11 are placed between the respective opposing pairs of the lower PC columns 10L of row 1 and row 2, and row 3 and row 4, in row A and row B from below, and the first and second stages of the second PC beams 12 are placed between the respective opposing pairs of the lower PC columns 10L of row A and row B, in rows 1 to 6 from below. The first PC beams 11 of the first stage consist of the first fixedly supported PC beams 11A, the first PC beams 11 of the second stage consist of the second pivotally supported PC beams 11B, and the first PC beams 11 of the third stage consist of the first fixedly supported PC beams 11A. The second PC beams 12 of the first stage consist of the first fixedly supported PC beams 11A, and the second PC beams 12 of the second stage consist of the second pivotally supported PC beam 12B.

Then, as shown in FIG. 11(C), the first to third stages of the first PC beams 11 are placed between the respective opposing pairs of the lower PC columns 10L of row 2 and row 3, in row A and row B from below. These first PC beams 11 all consist of the first pivotally supported PC beams 11B.

Then, as shown in FIG. 12(D), one of the upper PC column parts 10Us is placed on top of the corresponding lower PC column part 10L at each point in row 1 to row 4, in row A and row B, and is connected to the corresponding lower PC column part 10L.

As shown in FIG. 12(E), the fourth and fifth stages of the first PC beams 11 are placed between the respective opposing pairs of the upper PC columns 10U of row 1 and row 2, and row 3 and row 4, in row A and row B from below, and the third to fifth stages of the second PC beams 12 are placed between the respective opposing pairs of the upper PC columns 10U of row A and row B, in row 1 to row 4, from below in each case. The first PC beams 11 of the fourth stage are the first pivotally supported PC beam 11B, and the first PC beams 11 of the fifth stage are the first fixedly supported PC beams 11A. The second PC beams 12 of the third stage are the second fixedly supported PC beam 12A, the second PC beams 12 of the fourth stage are the second pivotally supported PC beam 12B, and the second PC beams 12 of the fifth stage are the second fixedly supported PC beam 12A.

As shown in FIG. 12(F), the fourth and fifth stages of the first PC beams 11 are placed between the opposing pairs of the upper PC columns 10U of row 2 and row 3, in row A and row B from below. These first PC beams 11 all consist of the first pivotally supported PC beams 11B.

As shown in FIG. 13(G), the first to third stages of the first PC beams 11 are placed between the opposing pairs of the lower PC columns 10L of row 4 and row 5 and row 5 and row 6, in row A and row B from below. These first PC beams 11 all consist of the first pivotally supported PC beams 11B.

Then, as shown in FIG. 13(H), one of the upper PC column parts 10U is placed on top of the corresponding lower PC column part 10L at each point in row 5 and row 6, in row A and row B, and is connected to the lower PC column part 10L.

Finally, as shown in FIG. 13(I), the fourth and fifth stages of the first PC beams 11 are placed between the opposing pairs of the upper PC columns 10U of row 4 and row 5, and row 5 and row 6, in row A and row B, and the third to fifth stages of the second PC beams 12 are placed between the respective opposing pairs of the upper PC columns 10U of row A and row B, in row 5 and row 6, from below in each case. This concludes the construction of the frame structure 1. The first PC beams 11 all consist of the first pivotally supported PC beams 11B. On the other hand, the second PC beams 12 of the third stage are the second fixedly supported PC beams 12A, the second PC beams 12 of the fourth stage are the second pivotally supported PC beams 12B, and the second PC beams 12 of the fifth stage are the second fixedly supported PC beams 12A.

The advantages and features of the frame structure 1 of the illustrated embodiment are discussed in the following.

As shown in FIGS. 3 and 8, the two longitudinal ends of each first fixedly supported PC beam 11A are rigidly connected to the corresponding opposing pair of the PC columns 10 via the first rebars 32 which are joined to the first main beam rebars 24 in the respective first blind holes 26 by the respective first overlap joints 33 and the grout filled around the first rebars 32 in the respective first through holes 31. Therefore, the first fixedly supported PC beam 11A can be positioned between the opposing pair of the PC columns 10 before positioning the first rebars 32, and the PC columns 10 and the first fixedly supported PC beam 11A can be properly positioned without requiring any of the members being moved horizontally along the main beam rebars. Also, as shown in FIGS. 11 to 13, the PC columns 10 and the first fixedly supported PC beam 11A can be positioned one after another in a highly efficient manner.

In the illustrated embodiment, each first blind hole 26 extends along and adjacent to the corresponding first main beam rebar 24, and the first main beam rebar 24 is dimensioned so as to overlap with the first rebar 32 in the corresponding first blind hole 26 by the prescribed joint length L1, and the first overlap joint 33 is formed by the overlapping parts of the first rebar 32 and the first main beam rebar 24 in the first blind hole 26 in cooperation with the grout filling the gap around the first rebar 32 in the first blind hole 26. Therefore, without requiring any mechanical coupling member, the PC column 10 and the first fixedly supported PC beam 11A can be rigidly connected to each other with a minimum material cost.

Owing to the provision of the first support portion 13 to each PC column 10 for supporting the corresponding first fixedly supported PC beam 11A, no temporary support fixture for supporting the first fixedly supported PC beam 11A is required when connecting the first fixedly supported PC beam 11A to the PC column 10 so that the construction work is facilitated.

In the illustrated embodiment, each first rebar 32 is provided with the radially expanded head 32*a* so that the first rebar 32 can be firmly anchored to the PC column 10 even when the cross sectional dimensions of the PC column 10 may be otherwise inadequate for retaining the first rebar 32 therein.

As shown in FIGS. 2 and 9, the two longitudinal ends of each second fixedly supported PC beam 12A are rigidly connected to the corresponding opposing pair of the PC columns 10 via the second rebars 44 which are joined to the second main beam rebars 41 in the respective second blind holes 42 by the respective second overlap joints 45 and the grout filled around the second rebars 44 in the respective second through holes 43. Therefore, the second fixedly supported PC beam 12A can be positioned between the opposing pair of the PC columns 10 before positioning the second rebars 44, and the PC columns 10 and the second fixedly supported PC beam 12A can be properly positioned without requiring any of the members being moved horizontally along the main beam rebars, also with respect to the second direction Y as well as to the first direction X. Thus, the PC columns 10 and the second fixedly supported PC beam 12A can be positioned one after another in a highly efficient manner.

As shown in FIGS. 1 and 2, the second fixedly supported PC beam 12A are rigidly connected to the corresponding PC columns 10 at different heights from the associated fixedly supported PC beam 11A. Therefore, the first through holes 31 and the second through holes 43 are comparatively separated from one another so that the quality of the PC columns 10 is prevented from being impaired from such causes as the inadequate penetration of concrete during the fabrication process of the PC column 10. Also, the quality of the structure can be ensured without requiring the dimensions of the members to be unduly increased.

As shown in FIG. 1, the fixedly supported PC beams 11A and the first pivotally supported PC beam 11B are arranged in an alternating manner along both the first direction X and the vertical direction. Therefore, not all of the first PC beams 11 arranged along the first direction X are required to be rigidly connected to the corresponding PC columns 10 so that not only the material cost is saved but also the construction work is simplified owing to the reduction in the parts where the connecting work between the first rebars 32 and the first main beam rebars 24 is required.

The lower PC column parts 10L and the upper PC column parts 10U are dimensioned so as to support a plurality of stages of the first PC beams 11. Therefore, the number of PC column parts that are required can be minimized so that the overall material cost can be reduced, and the construction work is simplified.

The method of constructing the frame structure 1 of the illustrated embodiment includes the steps of erecting a pair of the PC columns 10 along the first direction X as shown in FIG. 11(A), positioning the fixedly supported PC beams 11A between the two PC columns 10 so that the first blind holes 26 oppose the corresponding first through holes 31 as shown in FIGS. 11(B) and 8, inserting each first rebar 32 into the corresponding first through hole 31 and first blind hole 26 so that the first rebar 32 overlaps with the first main beam rebar 24 in the first blind hole 26 by the prescribed joint length L1, and introducing grout into the first through holes 31 and the first blind holes 26 so that each rebar 32 is joined to the first fixedly supported PC beams 11A and is retained in the PC column 10. Thereby, the PC column 10 and the first fixedly supported PC beams 11A can be rigidly connected to each other without requiring a mechanical joint member. Because the first fixedly supported PC beams 11A can be positioned between the corresponding pair of the PC columns 10 before positioning the first rebars 32, the positioning of the PC columns 10 and the first fixedly supported PC beams 11A can be facilitated. Thus, the PC columns 10 and the first fixedly supported PC beams 11A can be positioned one after another in a highly efficient manner.

Second Embodiment

A second embodiment of the present invention is described in the following with reference to FIGS. 14 and 15. In the following description, the parts corresponding to those of the first embodiment are denoted with like numerals without necessarily repeating the description of such parts.

Figure 14:
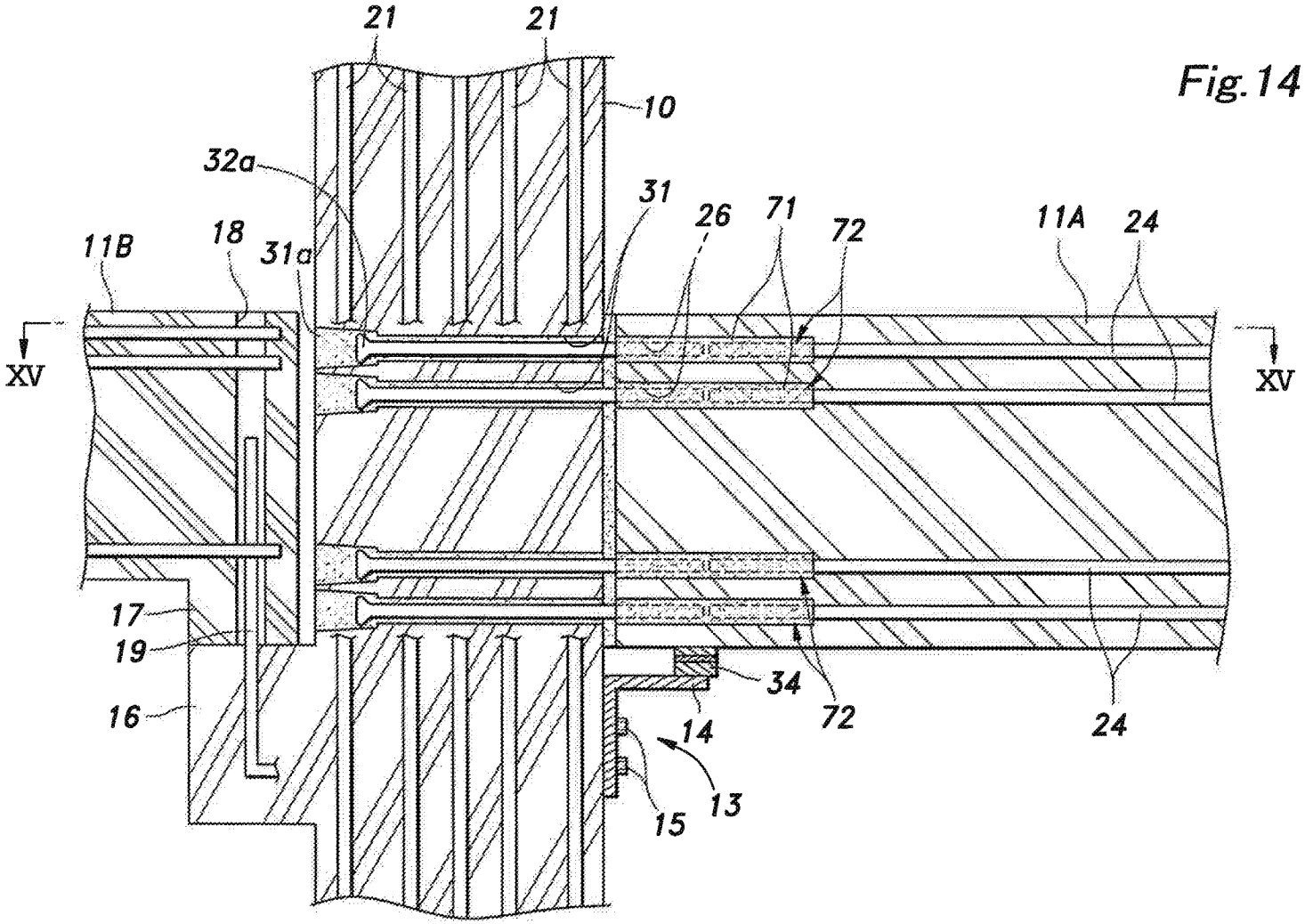
FIG. 14 is an enlarged sectional view similar to FIG. 3, showing a frame structure given as a second embodiment.
Figure 15:
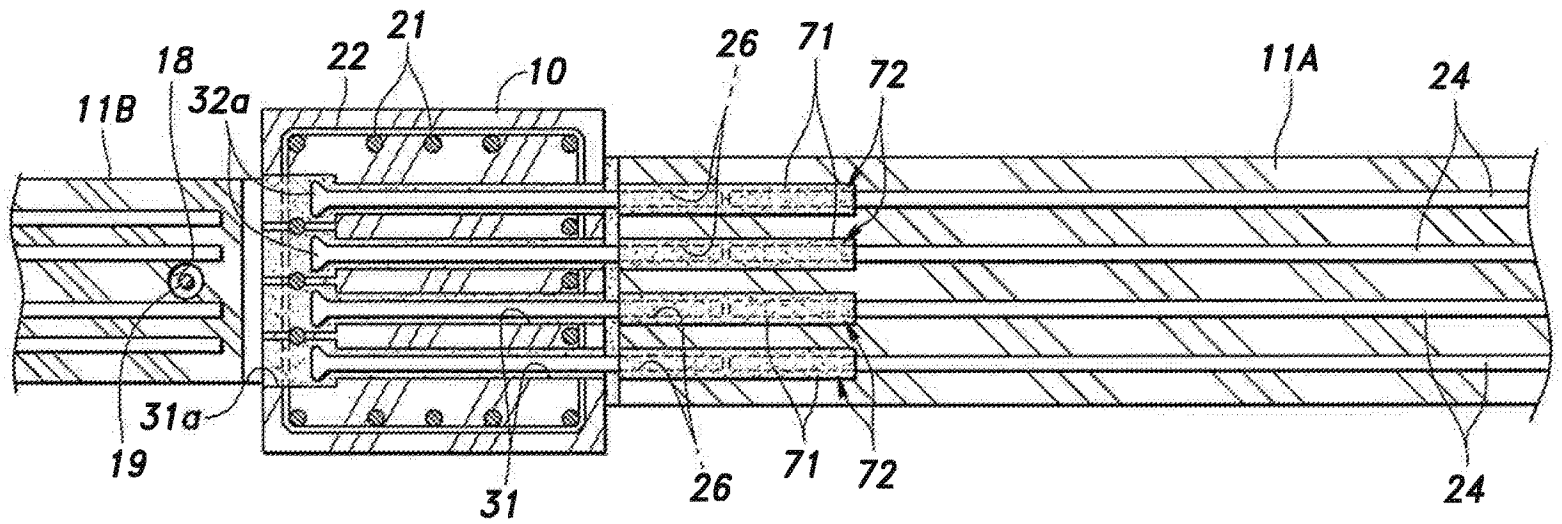
FIG. 15 is a sectional view taken along line XV-XV of FIG. 14.

FIG. 14 is an enlarged sectional side view similar to FIG. 3 of the first embodiment, showing a frame structure 1 given as a second embodiment, and FIG. 15 is a sectional plan of view of the frame structure 1 taken along line XV-XV of FIG. 14 similar to FIG. 4 of the first embodiment. In this embodiment, the first main beam rebars 24 extend linearly along the entire longitudinal length of each first fixedly supported PC beam 11A in parallel with the longitudinal direction, and a sleeve 71 is fitted on an end part of each first main beam rebar 24. Each sleeve 71 consists of a tubular member made of steel internally defining a bore, and forms a mechanical joint 72 that joins the first main beam rebar 24 inserted halfway in the bore with the first rebar 32 also halfway inserted in the bore from the opposite direction.

In the illustrated embodiment, the sleeve 71 retains the first main beam rebar 24 and the first rebar 32 both having ribbed outer surfaces in the bore, in particular via the grout that fills the gap around the first main beam rebar 24 and the first rebar 32 received in the bore. In an alternate embodiment, the bore of the sleeve 71 is formed with a female thread, and the ends parts of the first main beam rebar 24 and the first rebar 32 are formed with male threads that are threaded into the bore from the opposite directions so that the first main beam rebar 24 and the first rebar 32 may be retained by the sleeve 71. If desired, fastening nuts and grout may be used in combination to retain the first main beam rebar 24 and the first rebar 32 in the sleeve 71.

More specifically, before the first fixedly supported PC beam 11A is rigidly connected to the associated PC columns 10, a longitudinal end of each first main beam rebar 24 is retained by the corresponding longitudinal end part of the sleeve 71 in such a manner that the bore of the opposite longitudinal end part of the sleeve 71 defines a first blind hole 26 opening out from the longitudinal end surface of the first fixedly supported PC beam 11A. The first fixedly supported PC beam 11A is then positioned between the two PC columns 10 so that the first blind holes 26 oppose the respective first through holes 31. Similarly as the first embodiment discussed in conjunction with FIG. 8, the first rebars 32 are inserted into each first through hole 31 and the corresponding first blind hole 26 from the side of the first through hole 31. Grout is introduced into the gap between the first fixedly supported PC beam 11A and each associated PC column 10 so that the first blind holes 26 and the first through holes 31 are filled with the grout. Once the grout is cured, the first fixedly supported PC beam 11A is rigidly connected to the associated PC columns 10 via the first rebars 32 joined to the corresponding first main beam rebars 24 via the respective mechanical joints 72 and the grout filled around each first rebar 32 in the corresponding first through hole 31.

The illustrated structure for connecting the first fixedly supported PC beams 11A to the associated PC columns 10 also provide advantages similar to those of the first embodiment. More specifically, each first fixedly supported PC beam 11A can be positioned between the opposing pair of the PC columns 10 before positioning the first rebars 32, and the PC columns 10 and the first fixedly supported PC beam 11A can be properly positioned without requiring any of the members being moved horizontally along the main beam rebars. Also, as shown in FIGS. 11 to 13, the PC columns 10 and the first fixedly supported PC beam 11A can be positioned one after another in a highly efficient manner.

In the illustrated embodiment, each first blind hole 26 is defined by the corresponding sleeve 71 retaining the longitudinal end part of the corresponding first main beam rebar 24, and the sleeve 71 forms the mechanical joint 72 retaining the longitudinal end of the corresponding first main beam rebar 24. Therefore, the mechanical joint 72 is enabled to connect the first rebar 32 to the corresponding first main beam rebar 24 in a reliable manner.

Although the present invention has been described in terms of preferred embodiments thereof, it is obvious to a person skilled in the art that various alterations and modifications are possible without departing from the scope of the present invention. For instance, the frame structure 1 of the present invention was applied to a pipe rack in the foregoing embodiments, but can also be applied to other structures as can be readily appreciated by a person skilled in the art. The various structures, arrangements, numbers and angles of various components and parts as well as various manufacturing/construction steps can be altered or modified without departing from the spirit of the present invention. Also, the various components used in the foregoing embodiments are not entirely essential for the present invention, but may be suitably omitted without departing from the spirit of the present invention.

| | | | |
|---|---|---|---|
| 1 | frame structure | 2 | column |
| 3 | first beam | 4 | second beam |
| 10 | PC column | 10L | lower PC column part |
| 10U | upper PC column part | 11 | first PC beam |
| 11A | first fixedly supported PC beam (fixedly supported at both ends) | | |
| 11B | first pivotally supported PC beam (pivotally supported at both ends) | | |
| 12 | second PC beam | | |
| 12A | second fixedly supported PC beam (fixedly supported at both ends) | | |
| 12B | second pivotally supported PC beam (pivotally supported at both ends) | | |
| 13 | first support portion (support portion) | | |
| 24 | first main beam rebar | 26 | first blind hole |
| 31 | first through hole | 32 | first rebar |
| 32a | head (anchoring portion) | 33 | first overlap joint (first joint) |
| 41 | second main beam rebar | 42 | second blind hole |
| 43 | second through hole | 44 | second rebar |
| 45 | second overlap joint (first joint) | 71 | sleeve |

-continued

| | | | |
|---|---|---|---|
| | | | (tubular member) |
| 72 | mechanical joint (first joint) | | |
| X | first direction | Y | second direction |

The invention claimed is:

1. A frame structure comprising a plurality of precast concrete (PC) columns arranged in a first direction and a second direction crossing the first direction in plan view, at least one first PC beam incorporated with first main beam rebars including an upper rebar and a lower rebar each extending in a longitudinal direction of the at least one first PC beam and embedded in the at least one first PC beam so as not to protrude from longitudinal ends of the at least one first PC beam, each first PC beam being supported by a pair of the PC columns adjoined by the beam in the first direction, and at least one second PC beam incorporated with second main beam rebars including an upper rebar and a lower rebar each extending in a longitudinal direction of the at least one second PC beam and embedded in the at least one second PC beam so as not to protrude from longitudinal ends of the at least one second PC beam, each second PC beam being supported by a pair of the PC columns adjoined by the beam in the second direction;

wherein the at least one first PC beam comprises at least one fixedly supported beam each formed with first blind holes opening out from each longitudinal end surface thereof so as to each form a first joint for a corresponding end of the corresponding first main beam rebar, and each of the adjoined PC columns is formed with first through holes opening out opposite to the first blind holes;

wherein each longitudinal end of each fixedly supported beam included in the at least one first PC beam is rigidly connected to the corresponding PC column by a first rebar having one end terminating in each first blind hole of the at least one fixedly supported beam of the at least one first PC beam and another end terminating in the corresponding first through hole of the adjoined PC column, the first rebar being connected to the corresponding first main beam rebar via the first joint, and a gap defined around the first rebar in the first through hole being filled with grout;

wherein the at least one second PC beam comprises at least one fixedly supported beam each formed with second blind holes opening out from each longitudinal end surface thereof so as to each form a second joint for a corresponding end of the corresponding second main beam rebar, and each of the adjoined PC columns is formed with second through holes opening out opposite to the respective second blind holes; and wherein each longitudinal end of each fixedly supported beam included in the at least one second PC beam is rigidly connected to the corresponding PC column by a second rebar having one end terminating in each second blind hole of the at least one fixedly supported beam of the at least one second PC beam and another end terminating in the corresponding second through hole of the adjoined PC column, the second rebar being connected to the corresponding second main beam rebar via the second joint, and a gap defined around the second rebar in the second through hole being filled with grout.

2. The frame structure according to claim 1, wherein each first blind hole extends along and adjacent to the corresponding first main beam rebar, and the first main beam rebar overlaps with the first rebar over a prescribed joint length, the first joint consisting of an overlap joint formed by an overlapping part of the first rebar overlapping with the first main beam rebar and received in the first blind hole with the grout filled in the gap around the first rebar in the first blind hole.

3. The frame structure according to claim 1, wherein each first blind hole is formed by a tubular member retaining a longitudinal end part of the first main beam rebar, and each first joint consists of a mechanical joint configured to retain the longitudinal end part of the first rebar with the tubular member.

4. The frame structure according to claim 1, wherein each first rebar is provided with a radially projecting anchoring part positioned inside the corresponding first through hole.

5. The frame structure according to claim 1, wherein each PC column is provided with a support portion for supporting the corresponding first PC beam.

6. The frame structure according to claim 1, wherein the at least one fixedly supported beam included in the at least one first PC beam is rigidly connected to the associated PC columns at a different height from the at least one fixedly supported beam included in the at least one second PC beam.

7. The frame structure according to claim 1, wherein the plurality of PC columns comprises at least three PC columns arranged in the first direction, and the at least one first PC beam further comprises at least one simple beam each having two ends pin-connected to the adjoined PC columns in such a manner that the at least one simple beam and the at least one fixedly supported beam alternate one next to the other in the first direction.

8. The frame structure according to claim 1, wherein the at least one first PC beam comprises a plurality of PC beams that are supported by a pair of the PC columns adjoined by the PC beams in the first direction at different elevations, the PC columns being dimensioned to support the first PC beams at the different elevations.

9. The frame structure according to claim 1, wherein the at least one first PC beam comprises a plurality of PC beams that are supported by a pair of the PC columns adjoined by the PC beams in the first direction at different elevations, wherein the plurality of PC beams comprises some of the at least one fixedly supported beam and at least one simple beam each having two ends pin-connected to the adjoined PC columns in such a manner that the at least one simple beam and the at least one fixedly supported beam alternate one next to the other in a vertical direction.

10. A method of constructing a frame structure including a plurality of PC columns arranged in a first direction and a second direction crossing the first direction in plan view, at least one first PC beam each rigidly supported by a pair of the PC columns adjoined by the beam in the first direction, and at least one second PC beam each rigidly supported by a pair of the PC columns adjoined by the beam in the second direction, the method comprising the steps of:

preparing the at least one first PC beam incorporated with first main beam rebars including an upper rebar and a lower rebar each extending in a longitudinal direction of the first PC beam and embedded in the at least one first PC beam so as not to protrude from longitudinal ends of the at least one first PC beam, each first PC beam being formed with first blind holes opening out from each longitudinal end surface thereof so as to form first joints in end parts of the respective first main beam rebars;

preparing the at least one second PC beam incorporated with second main beam rebars including an upper rebar and a lower rebar each extending in a longitudinal direction of the second PC beam and embedded in the at least one second PC beam so as not to protrude from longitudinal ends of the at least one second PC beam, each second PC beam being formed with second blind holes opening out from each longitudinal end surface thereof so as to form second joints in end parts of the respective second main beam rebars;

preparing the PC columns each having first through holes and second through holes opening out at mutually different side surfaces thereof;

placing the PC columns along the first direction and the second direction in plan view;

placing each first PC beam between a pair of the PC columns associated with the beam so that the first blind holes oppose the corresponding first through holes;

inserting a first rebar into each first through hole and the corresponding first blind hole such that one end of the first rebar terminates in each first through hole and another end of the first rebar terminates in the corresponding first blind hole, and connecting the first rebar with the corresponding first main beam rebar via the corresponding first joint;

filling each first through hole with grout to fixedly secure the first rebar to the corresponding PC column;

placing each second PC beam between a pair of the PC columns associated with the beam so that the second blind holes oppose the corresponding second through holes;

inserting a second rebar into each second through hole and the corresponding second blind hole such that one end of the second rebar terminates in each second through hole and another end of the second rebar terminates in the corresponding second blind hole, and connecting the second rebar with the corresponding second main beam rebar via the corresponding second joint; and filling each second through hole with grout to fixedly secure the second rebar to the corresponding PC column.

* * * * *